US006276957B1

(12) United States Patent
Seko et al.

(10) Patent No.: US 6,276,957 B1
(45) Date of Patent: Aug. 21, 2001

(54) CONNECTOR

(75) Inventors: Satomi Seko; Masamitsu Chishima; Yukinori Saka, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/545,097

(22) Filed: Apr. 6, 2000

Related U.S. Application Data

(62) Division of application No. 09/150,541, filed on Sep. 9, 1998.

(30) Foreign Application Priority Data

Sep. 9, 1997 (JP) ..... 9-243985
Sep. 9, 1997 (JP) ..... 9-243986
Sep. 10, 1997 (JP) ..... 9-277606

(51) Int. Cl.[7] ..... H01R 13/71
(52) U.S. Cl. ..... 439/489; 439/188; 439/352
(58) Field of Search ..... 439/488–489, 439/350, 352, 188, 259

(56) References Cited

U.S. PATENT DOCUMENTS

| | | | |
|---|---|---|---|
| 5,275,575 | 1/1994 | Cahaly et al. | 439/188 |
| 5,391,087 | 2/1995 | Fukuda | 439/188 |
| 5,586,903 | 12/1996 | Hoffmann | 439/352 |
| 5,647,757 | 7/1997 | Chrysostomou | 439/352 |
| 5,685,743 | 11/1997 | Schmidt et al. | 439/352 |
| 5,688,141 | 11/1997 | Dullin | 439/352 |
| 5,807,130 * | 9/1998 | Miller et al. | 439/352 |
| 5,853,298 | 12/1998 | Pacher | 439/352 |

FOREIGN PATENT DOCUMENTS

| | | |
|---|---|---|
| 0 583 056 | 2/1994 | (EP) . |
| 0 591 947 | 4/1994 | (EP) . |
| 0 624 930 | 11/1994 | (EP) . |
| 0 734 101 | 9/1996 | (EP) . |

* cited by examiner

*Primary Examiner*—Hien Vu
(74) *Attorney, Agent, or Firm*—Anthony J. Casella; Gerald E. Hespos

(57) ABSTRACT

A connector is provided to independently perform connection detection and short releasing functions. The connector includes a connection detecting member 55 and a separate short releasing member 50. A connector is assembled by fitting a female connector housing 21 into a male connector housing 11, mounting the connection detecting member 55 and then mounting the short releasing member 50. The connected state of the connector housings 11, 21 is detected based on whether or not the connection detecting member 55 can be mounted on the female connector housing 21. If the short releasing member 50 is mounted after the two connector housings are properly connected, the shorted state of male tabs 13 is released in the male connector housing. Since the connection detecting member 55 and the short releasing member 50 are such separate members as to be independently mountable and detachable, both the connection detection and the short releasing can properly be performed.

4 Claims, 28 Drawing Sheets

CONNECTOR

This application is a Divisional of Ser. No. 09/150,541 filed Sep. 9, 1998.

BACKGROUND OF THE INVENTION

1. Field of the Invention

The present invention relates to an electrical connector.

2. Description of the Prior Art

Japanese Unexamined Patent Publication No. 6-208867 discloses a prior art electrical connector provided with both a function of detecting a connected state of connectors and a function of releasing a shorted state of terminal fittings. As shown in FIGS. 42 and 43 of this application, a female connector 1 is formed with a pair of elastic lock portions 2, and an engaging member 3 is mountable thereon. A pair of connection detecting portions 4, 5 project from the engaging member 3. The leading end of one connection detecting portion 4 is longer than that of the other and acts as a short releasing portion 4A. A male connector 6 is comprised of two male tabs 7, a shorting fitting 8 which can elastically be brought into contact with the male tabs 7, and a lock groove 9.

Before the connectors 1, 6 are assembled, the shorting fitting 8 is elastically in contact with the male tabs 7, thereby shorting them. The assembling operation is performed by fitting the female connector 1 into the male connector 6 with the engaging member 3 detached and then mounting the engaging member 3 on the female connector 1.

When the connectors 1, 6 are properly connected, the elastic lock portions 2 are engaged with the lock groove 9 and the connection detecting portions 4, 5 enter deformation permitting spaces inside the elastic lock portions 2 to prevent the lock portions 2 from being elastically deformed in an unlocking direction, thereby effecting double locking. However, if the connectors 1, 6 are partly connected, the elastic lock portions 2 are displaced into the deformation spaces without being engaged with the lock groove 9 and accordingly the connection detecting portions 4, 5 cannot enter the deformation space. Thus, the engaging member 3 cannot be mounted properly. In other words, the connected state of the connectors 1, 6 can be discriminated based on whether or not the engaging member 3 can be mounted.

When the connectors 1, 6 are properly connected and the engaging member 3 is properly mounted, the short releasing portion 4A elastically deforms the shorting fitting 8 as shown in FIG. 43, thereby disengaging it from one of the male tabs 7. As a result, the shorted state of the male tabs 7 is released.

The above prior art connector is used for an air bag circuit of an automotive vehicle. As a measure to prevent an air bag from being inadvertently actuated, the male tabs 7 are kept shorted while the connectors 1, 6 are not connected. Accordingly, it should be avoided that the shorted state of the male tabs 7 be released before the male tabs 7 and female terminal fittings (not shown) are securely electrically connected and that the male tabs 7 be kept shorted even after the male tabs 7 and the female terminal fittings are disengaged.

For this purpose, the detection by the connection detecting portions 4, 5 and the short releasing by the short releasing portion 4A need to be performed at proper timings. This is because of a likelihood that the following undesirable event or the like may occur. If the timings of the above operations are improper, the detection by the connection detecting portions 4, 5 is delayed, for example, when the connectors 1, 6 are partly connected. Accordingly, the shorted state of the male tabs 7 is released by the short releasing portion 4A despite the fact that the male tabs 7 and the female terminal fittings are not in secure electrical connection.

However, since the connection detecting portions 4, 5 and the short releasing portion 4A are formed integrally in the prior art connector, it may be difficult to properly set the timings of the two operations in the case that there is a restriction in the shape, size or the like of the connectors.

Another prior art connector is constructed such that terminal fittings are inserted in a connector housing, and these terminal fittings are connected with mating terminal fittings by connecting the connector with a mating connector. In such a connector, the connection of the terminal fittings is unstable in the case that the terminal fittings are not in their proper insertion positions or the connectors are not properly connected. Accordingly, the connector housing is provided with an elastic lock portion for holding the connector connected with the mating connector. A retainer for holding the terminal fittings in their proper insertion positions is mounted thereon.

Since the retainer cannot be mounted properly when the terminal fittings are insufficiently inserted, the inserted state of the terminal fittings can be detected based on whether or not the retainer can be assembled. This prevents the terminal fittings from being left insufficiently inserted.

The elastic lock portion effects no locking function if the connectors are connected only partly. On the other hand, the elastic locking portion does perform its locking function by being engaged with a mating locking portion once the connectors are properly connected. Accordingly, the connected state of the connectors can be detected based on whether the elastic lock portion is effecting its locking function. This prevents the connectors from being left partly connected.

In the above prior art connector, the insufficient insertion of the terminal fittings is detected only when the retainer is assembled. Thus, if the insufficient insertion detection by the retainer is overlooked, there is a likelihood that the connectors are connected without the insufficient insertion being detected at a later stage.

In view of the above problem, an object of the present invention is to provide an improved connector having an easier handling.

SUMMARY OF THE INVENTION

According to the invention, there is provided a connector a connector housing connectable with a mating connector housing. At least one elastic lock portion is displaceable to a lock position when the connector housings are properly connected, thereby locking the connector housings so as not be disengageable from each other. The elastic lock portion also is displaceable to an unlock position when the connector housings are connected only partly. A connection detecting member is permitted to be mountable or movable on the connector housing when the elastic lock portion is in its lock position, and is prevented from being mounted or movable on the connector housing when the elastic lock portion is in its unlock position. A short releasing member also is provided and comprises a short releasing portion for releasing the shorted state of terminal fittings in the mating connector housing by being mounted or moved on the connector housing that has been connected properly with the mating connector housing.

According to a preferred embodiment of the invention, the short releasing member is separate from the connection detecting member. Accordingly, it is possible to independently perform the connection detection and the short releasing.

This connector is assembled by connecting both connector housings, mounting the connection detecting member and then mounting the short releasing member. Since the elastic lock portion is displaced to its unlock position when the connector housing are connected only partly, the connection detecting member cannot be mounted in this condition. Accordingly, the partial connection of the connector housings is detected. After the short releasing member is mounted, the shorted state of the terminal fittings is released in the mating connector housing. When the connector housings are to be disconnected, the short releasing member is first detached to short the terminal fittings. The connection detecting member then is detached and the connector housings are separated. In the present invention, both the connection detection and the short releasing can be performed properly since the connection detecting member and the short releasing member are separate members and independently mountable and detachable.

Preferably, the connection detecting member and the short releasing member are displaceable or movable along directions arranged at an angle different from 0° or 180°, and preferably substantially normal with respect to each other.

Most preferably, the short releasing member is displaceable or movable along a direction that is substantially parallel to a mating direction of the connector housing and the mating connector housing.

According to a further preferred embodiment, there are further provided a biasing means for biasing the short releasing member in a direction away from the connector housing. Additionally, a holding means is provided on the connection detecting member for holding the short releasing member on the connector housing when the connection detecting member is mounted in a proper position on the connector housing.

Since the connection detecting member cannot be mounted on the connector housing when the connector housings are connected only partly, the biasing means prevents the mounting of the short releasing member. On the other hand, when the connector housings are connected properly and the connection detecting member is mounted on the connector housing, the connection detecting member holds the short releasing member in its mount state and the shorted state is released. In other words, there is no likelihood that the shorted state is kept when the connector housings are connected only partly.

Preferably, the biasing means comprises a compression coil spring, the connector housing permits cramping terminals that are provided with blades to be pressed thereinto, and the wires are brought into contact with the blades to establish an electrical connection by assembling the press cover with the connector housing. Since the biasing means comprises the compression coil spring, reliability is higher as compared with connectors in which the biasing means is integrally provided in the connector housing. Further, since the connector housing is of the type into which cramping terminal fittings are pressed, a retainer for locking the terminal fittings can be dispensed with.

According to the invention, there is further provided a connector, according to one of the preceding embodiments, comprising a connector housing connectable with a mating connector housing. At least one terminal fitting is insertable into the connector housing. A retainer is displaceably mountable on the connector housings between a partial lock position, where the insertion of the at least one terminal fitting is permitted, and a full lock position, where the at least one terminal fitting is held in its proper insertion position. At least one lock means is provided for locking the connector housing and the mating connector housing in their properly connected state. Displacement of the retainer from its partial lock position to its full lock position is prevented when the at least one terminal fitting is insufficiently inserted. Additionally, the lock means is provided integrally or unitarily on the retainer. Locking by the lock means is permitted when the retainer is in its full lock position while being impossible when the retainer is in its partial lock position.

When the terminal fittings are properly inserted, the retainer is displaced to its full lock position, thereby permitting the locking function by the lock means. Accordingly, the connector housings are locked in their properly connected state by the lock means. On the other hand, if the terminal fittings are insufficiently inserted, the retainer remains in its partial lock position by being unable to be displaced to its full lock position. Accordingly, the function of the lock means for locking the connector housings into each other is not effected.

In other words, the insufficient insertion of the terminal fitting can securely be detected twice, namely, a first time based on whether or not the retainer can be displaced to the full lock position, and a second time based on whether or not the locking function by the lock means is effectible. Accordingly, the insufficient insertion of the terminal fittings is detected.

Preferably, the connection of the connector housings is prevented by the lock means being struck against the mating connector housing when the retainer is in its partial lock position.

When the terminal fittings are insufficiently inserted, the connection of the connector housing is prevented by the lock means being struck against the mating connector housing and, accordingly, the locking function by the lock means is not effected. In other words, since the inserted state of the terminal fitting can be detected based on whether or not the connector housings can be connected smoothly, operability is better as compared with a case where the locking function by the lock means is confirmed after the connector housings are properly connected.

At least one lock means of a plurality of lock means may be provided on the retainer. Additionally, the retainer is mountable or insertable into the connector housing(s) along a direction arranged at an angle different from 0° or 180°, preferably substantially normal to the direction of insertion of the at least one terminal fitting into the connector housing.

These and other objects, features and advantages of the present invention will become more apparent upon a reading of the following detailed description and accompanying drawings.

BRIEF DESCRIPTION OF THE DRAWINGS

FIG. 16 is a vertical section of the third embodiment when a connection detecting member is partly locked and female terminal fittings are pressed in.

DETAILED DESCRIPTION OF THE EMBODIMENTS

Figure 1:
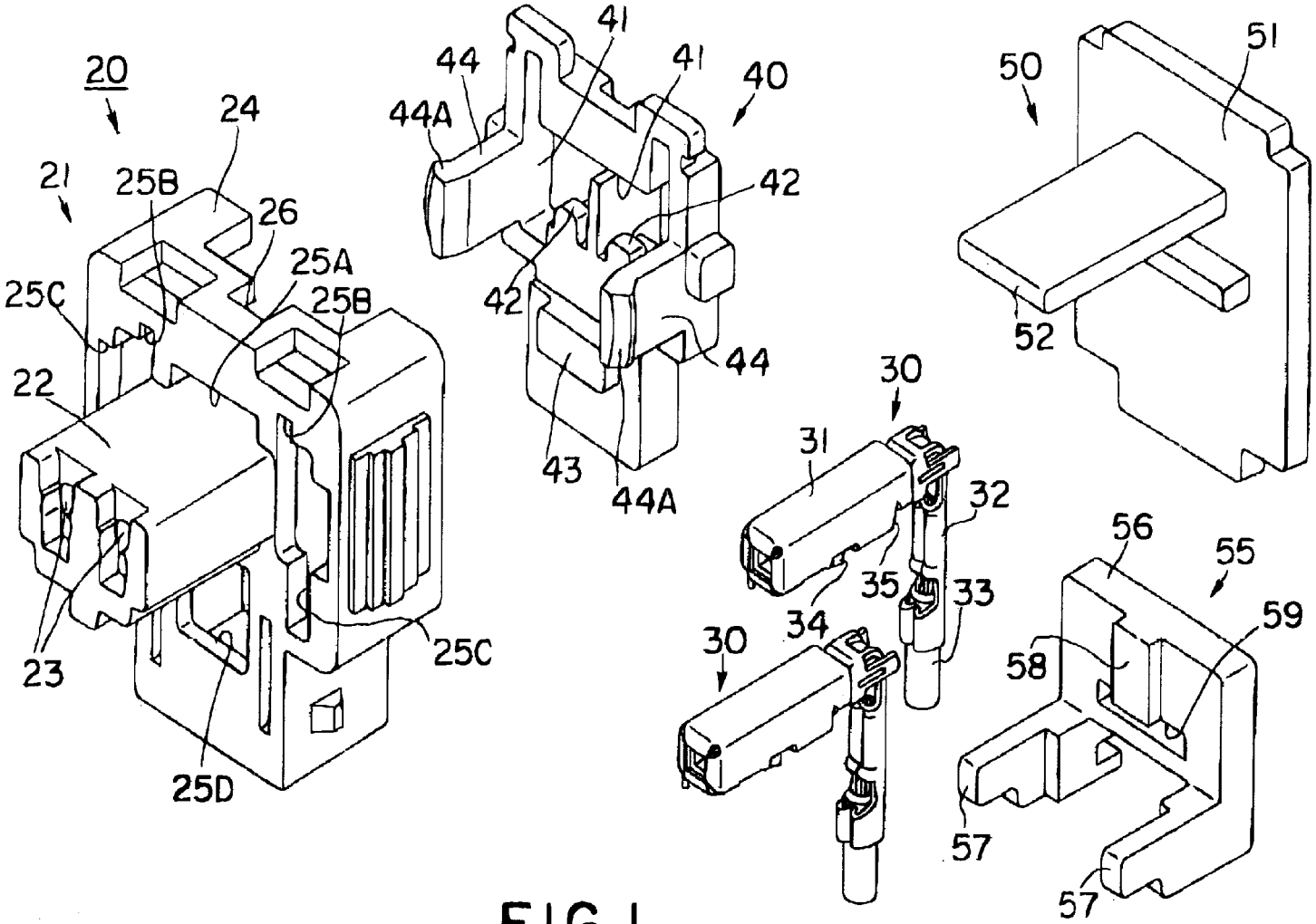
FIG. 1 is an exploded perspective view of a first embodiment.
Figure 2:
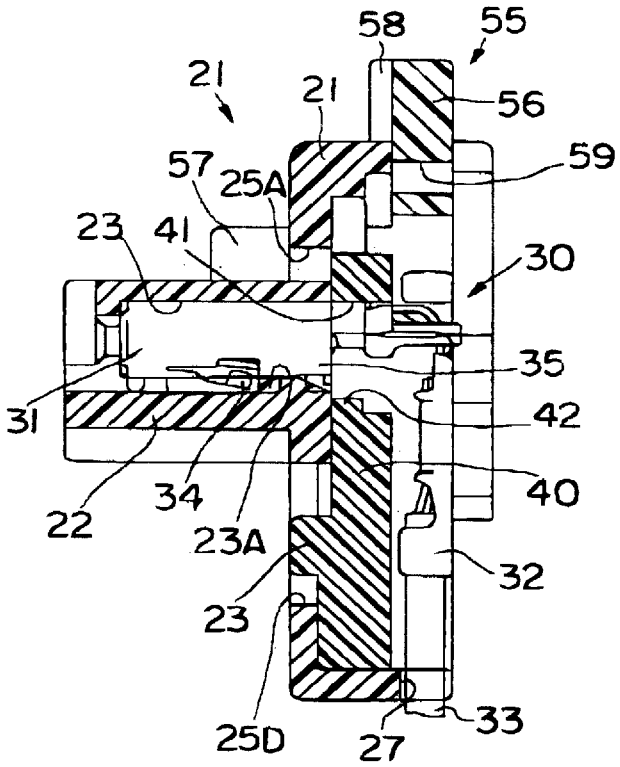
FIG. 2 is a vertical section of the first embodiment when a retainer and a connection detecting member are in their respective partial lock positions and a female terminal fittings are inserted.
Figure 3:
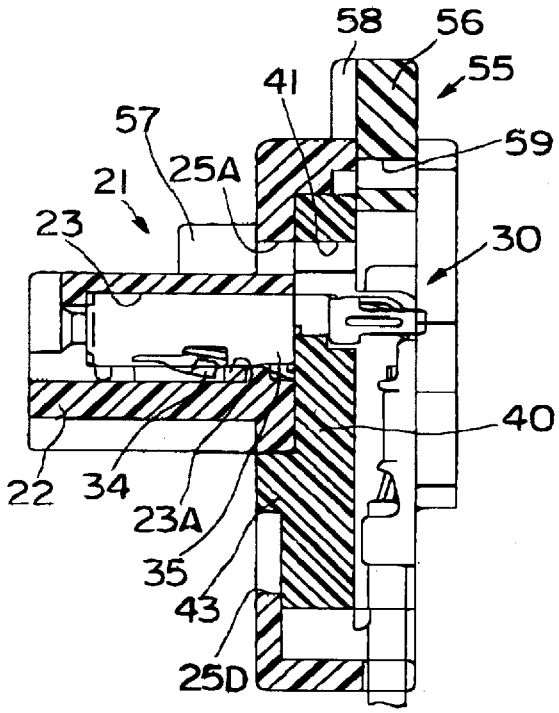
FIG. 3 is a vertical section of the first embodiment when the female terminal fittings are inserted, the connection detecting member is partly locked and the retainer is fully locked.

A male connector 10 and a female connector 20, according to a first embodiment, are illustrated in FIGS. 1–9. The male connector 10 as shown most clearly in FIGS. 4–6 and 9, is comprised of a male connector housing 11 formed with a receptacle 12 which has a substantially circular shape as a whole and is widely open in forward direction or a direction of connection with the female connector 20. The male connector 10 further has a pair of male tabs 13, and a shorting fitting 14 for shorting the male tabs 13. A positioning portion 15, preferably in the form of a recess into which a main body 22 of a female connector housing 21 is fittable, is formed in the back end surface of the male connector 10. Lock grooves 16 (FIG. 9) are formed in the lateral surfaces, preferably left and right side surfaces, of the receptacle 12; and a fitting accommodating portion 17 is formed in a lateral surface, preferably the ceiling surface, thereof. The shorting fitting 14 is provided at least partially in the fitting accommodating portion 17 and includes a pair of elastic contact portions 14A that preferably have their front ends coupled to establish an electrical connection and that extend backwardly to have their rear ends hanging free. When the shorting circuit 14 is in its free state, the downwardly facing rear ends of the elastic contact portions 14A are or can be elastically in contact with the male tabs 13, thereby shorting the male tabs 13. When the elastic contact portions 14A are lifted, the shorted state is released.

The female connector 20 is comprised of the female connector housing 21, female terminal fittings 30, a retainer 40, a short releasing member 50 and a connection detecting member 55 as shown most clearly in FIG. 1.

The female connector housing 21 includes the housing main body 22 having a pair of cavities 23 formed substantially side by side and a substantially box-shaped mount portion 24 which is substantially continuous with the rear end of the housing main body 22 and is open preferably backwardly and upwardly. The corresponding female terminal fitting 30 is inserted into each cavity 23 preferably through an opening at its substantially rear end, and a primary locking portion 23A engageable with the female terminal fitting 30 is formed in the cavity 23.

The mount portion 24 is formed with a short releasing portion (SRP) through hole 25A which extends through the front wall of the mount portion 24 and is substantially open along the upper surface of the housing main body 22. The mount portion 24 also is formed with a pair of connection detecting portion (CDP) through holes 25B which substantially extend along side surfaces of the housing main body 22. Elastic lock portion (ELP) through holes 25C extend along and communicate with the outer edge of the through holes 25B.

An operable hole 25D is formed in a position of the front wall of the mount portion 24 below the housing main body 22. A substantially vertically extending guide groove 26 is formed in the upper wall of the mount portion 24, and a pair of wire escape grooves 27 are formed in the bottom wall thereof.

The female terminal fitting 30 is comprised of a substantially box-shaped terminal main body 31 to be inserted into the cavity 23. A wire connection portion 32 extends substantially downward from the rear end of the terminal main body 31, and a wire 33 is connected with the wire connection portion 32 e.g. by cramping. In the lower surface of the terminal main body 31 is formed a metal lance or locking portion 34 to be lockingly engaged with the primary locking portion 23A of the cavity 23. A lower portion of the rear end surface of the terminal main body 31 acts as a receiving portion 35 engageable with the retainer 40 for effecting secondary locking.

The retainer 40 is in the form of a thick plate, and is so dimensioned as to be vertically displaceable (or to be displaceable in a plane arranged at an angle different from 0° or 180°, preferably substantially normal to the connection direction of the male and female connectors 10, 20) in or along the mount portion 24 of the female connector housing 21. In preferably an upper portion of the retainer 40 are formed a pair of through holes 41 which communicate with each other at their upper ends. Secondary locking portions 42 are engageable with the receiving portions 35 of the female terminal fittings 30 and project preferably at the bottom edges of the through holes 41. On the front surface of the retainer 40 is formed an operable projection 43 preferably in a position substantially below the through holes 41.

The retainer 40 is formed with elastic lock portions 44 for locking the connector housings 11, 21 in their properly engaged states. The elastic lock portions 44 project forward from the lateral, preferably left and right side ends of the front surface of the retainer 40, and lock claws 44A, which project outwardly are formed at the projecting ends of the elastic lock portions 44. The elastic lock portions 44 are in their free or undeflected states when they are in their lock positions, in which they are engageable with the lock grooves 16 of the male connector housing 11. Upon being elastically deformed inwardly, the elastic lock portions 44 are displaceable to their unlock positions where they are disengaged from the lock grooves 16. Spaces for connection detecting portions 57 exist between the elastic lock portions 44 and the side surfaces of the housing main body 22 when the elastic lock portions 44 are in their lock positions. With the elastic lock portions 44 displaced to their unlock positions, the clearances between the elastic lock portions 44 and the housing main body 22 are so narrowed that the connection detecting portions 57 cannot be inserted.

The short releasing member 50 is comprised of a plate-shaped main body 51 and a substantially plate-shaped short releasing portion 52 which horizontally projects (or projects substantially along the direction of insertion or connection of the male and female connectors 10, 20) from the front surface of the main body 51. The projecting end of the short releasing portion hangs free. The short releasing member 50 is mounted or is mountable on or in the female connector housing 21 in a partial lock position shown in FIG. 5 and in a full lock position shown in FIG. 6. In the partial lock position, since the short releasing portion 52 projects forwardly or substantially out from the SRP through hole 25A by a short distance, the short releasing portion 52 is not touching or at least not deflecting the shorting fitting 14 when the connector housings 11, 21 are connected. However, in the full lock position, the short releasing portion 52 projects by a long distance and engages the shorting fitting 14 when the connector housing 11, 21 are connected or fitted, thereby deforming the short fitting 14 or the elastic contact portions 14A thereof upwardly and/or away from the male tabs 13.

The connection detecting member 55 is comprised of a main body 56, and a pair of connection detecting portions 57 that project forwardly from the lateral, preferably left and right bottom ends of the main body 56. A substantially vertically extending guide projection 58 is formed preferably on the front surface of the main body 56, and a short releasing portion (SRP) through hole 59 is formed below the guide projection 58. The connection detecting member 55 is mounted or mountable on the female connector housing 21 by inserting the connection detecting portions 57 into the CDP through holes 25B from behind and by fitting the guide projection 58 into the guide groove 26, and can be held in the partial lock position (see FIGS. 2 and 3) and the full lock position (see FIGS. 4 and 5) located substantially below the partial lock position by an unillustrated locking means.

In the partly locked state of the connection detecting member 55, since the connection detecting portions 57 are located above the elastic lock portions 44, the elastic lock portions 44 are permitted to be deformed elastically to their unlock positions. On the other hand, the displacement of the elastic lock portions 44 to their unlock positions is restricted in the fully locked state of the connection detecting member 55, since the connection detecting portions 57 are at least partially located at substantially the same height as the elastic lock portions 44. Further, when the connection detecting member 55 is in its partial lock position, the SRP through hole 59 is displaced laterally or upwardly from or with respect to the SRP through hole 25A of the female connector housing 21. When the connection detecting member 55 is moved downwardly to its full lock position, both SRP through holes 25A, 59 are substantially aligned at the same height or correspond at least partially to each other.

Figure 4:
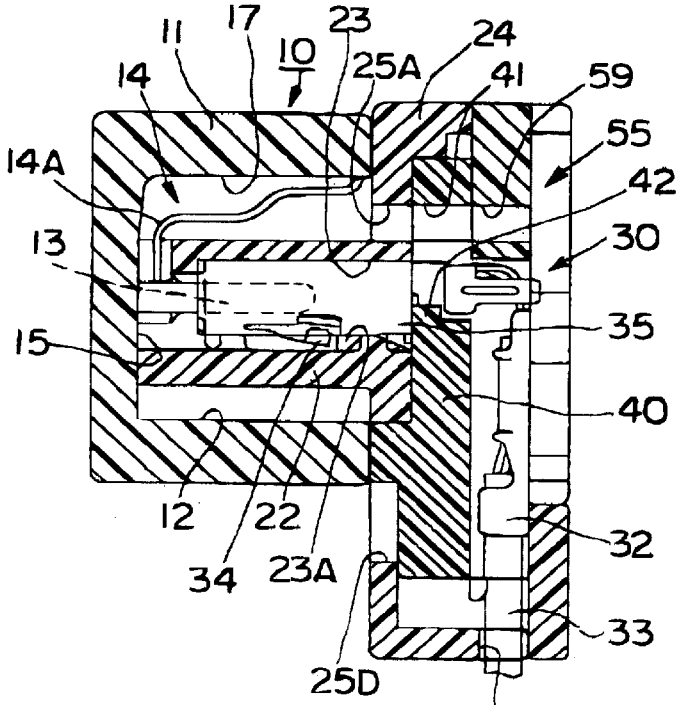
FIG. 4 is a vertical section of the first embodiment when the retainer and the connection detecting member are fully locked.
Figure 5:
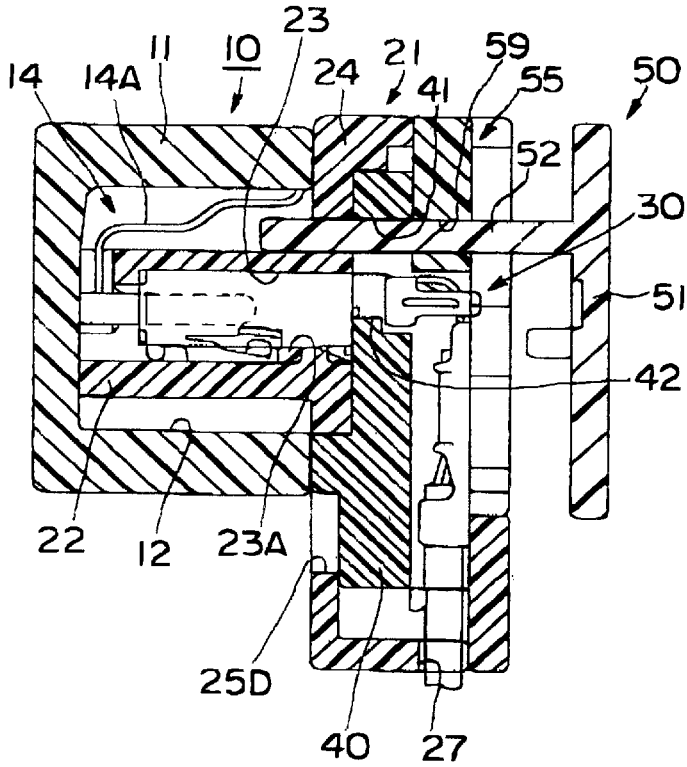
FIG. 5 is a vertical section of the first embodiment when the retainer and the connection detecting member are fully locked and the short releasing member is partly locked.
Figure 6:
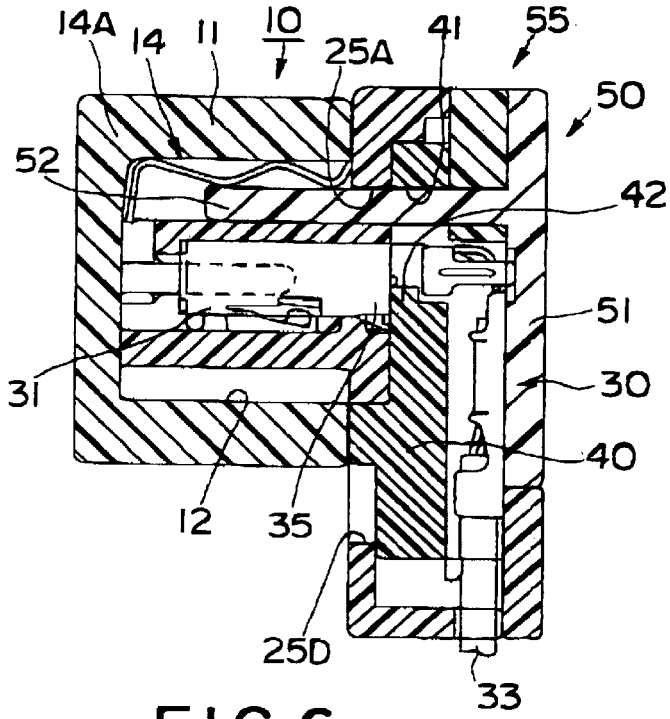
FIG. 6 is a vertical section of the first embodiment when the retainer, the connection detecting member and the short releasing member are fully locked.
Figure 7:
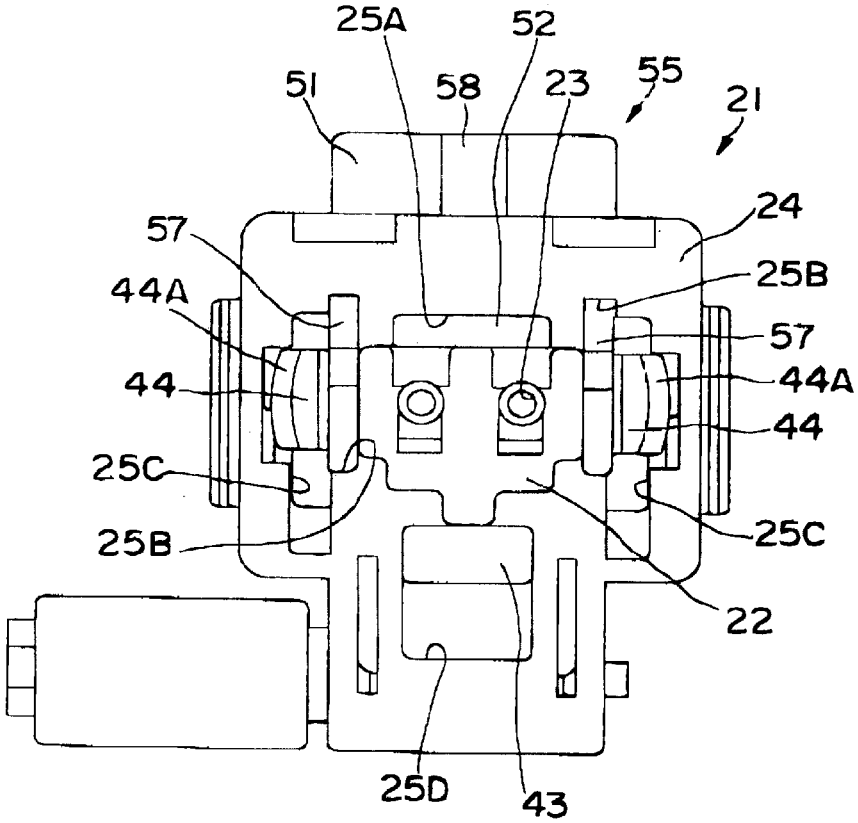
FIG. 7 is a front view of the first embodiment when the retainer is fully locked and the connection detecting member is partly locked.
Figure 8:
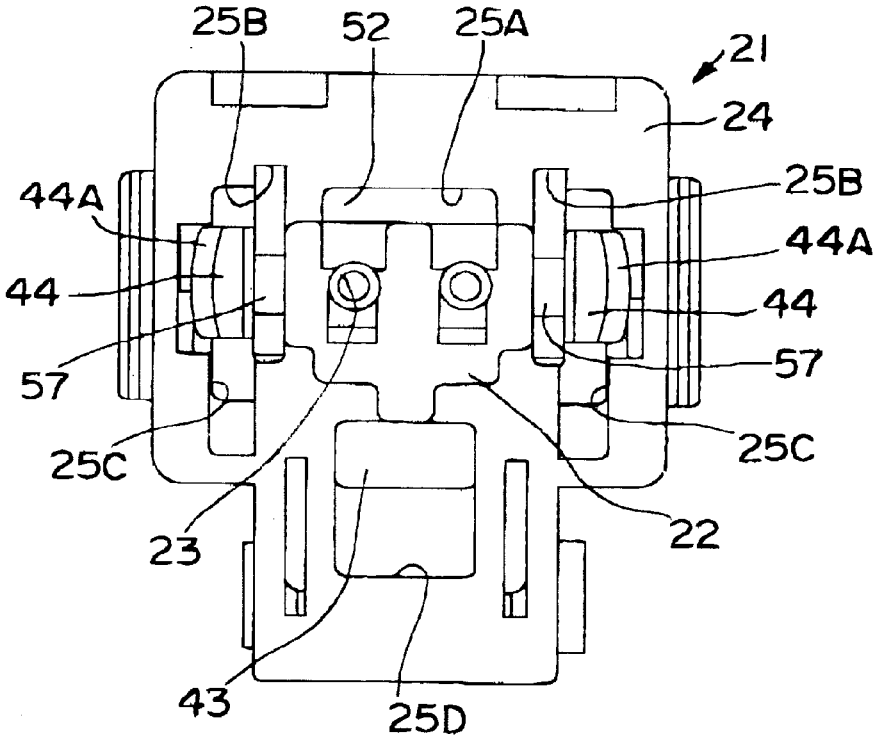
FIG. 8 is a front view of the first embodiment when the retainer and the connection detecting member are fully locked.
Figure 9:
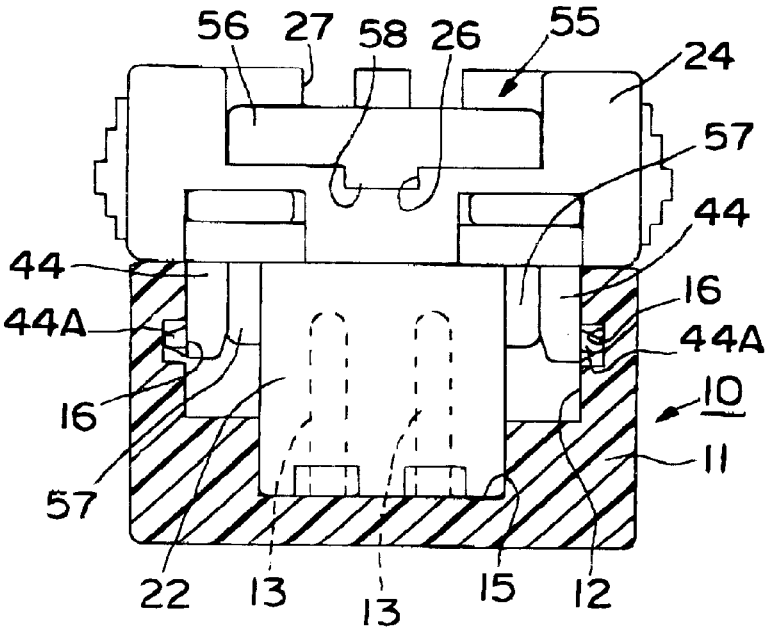
FIG. 9 is a horizontal section of the first embodiment when the connector housings are properly connected.
Figure 10:
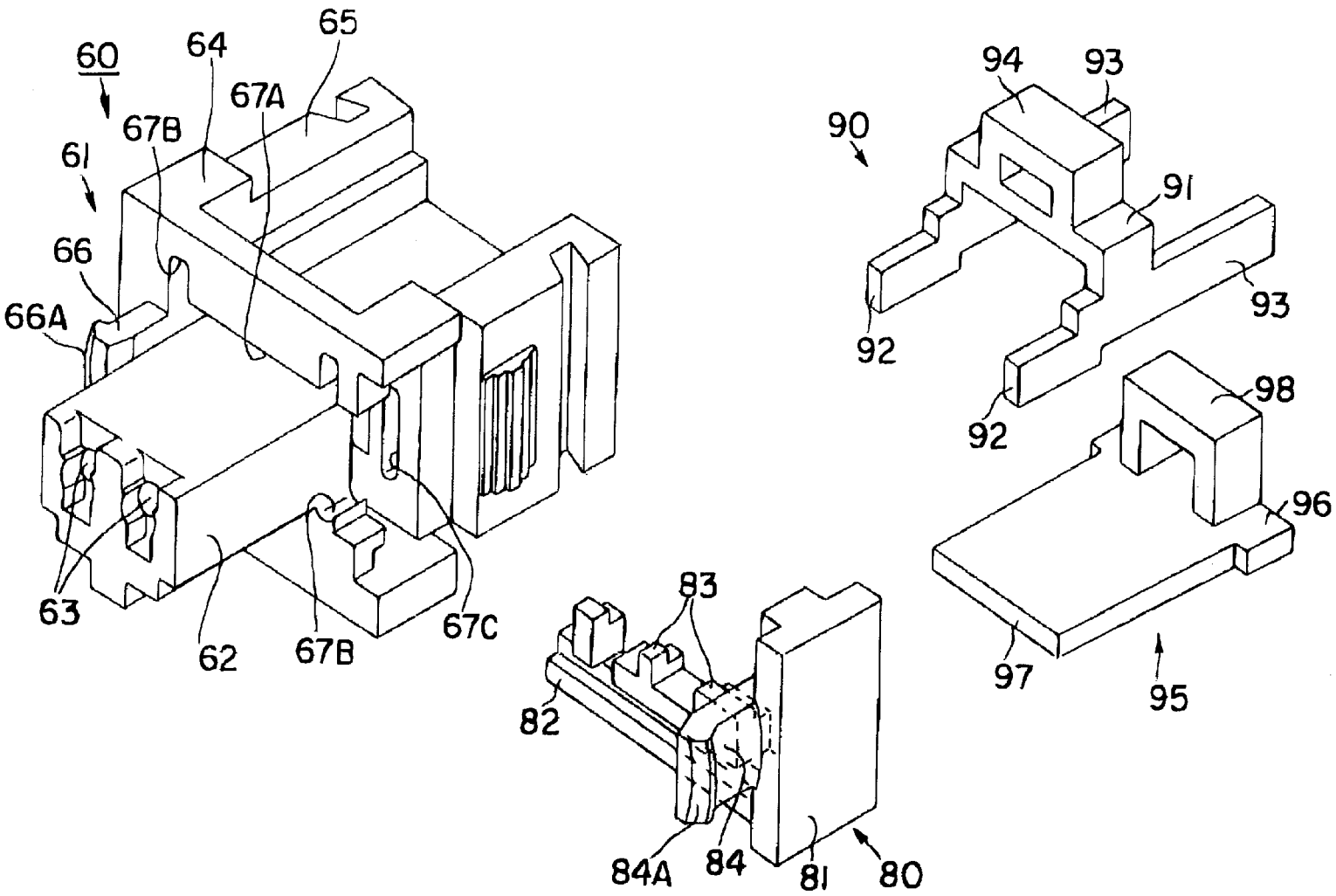
FIG. 10 is an exploded perspective view of a second embodiment.
Figure 11:
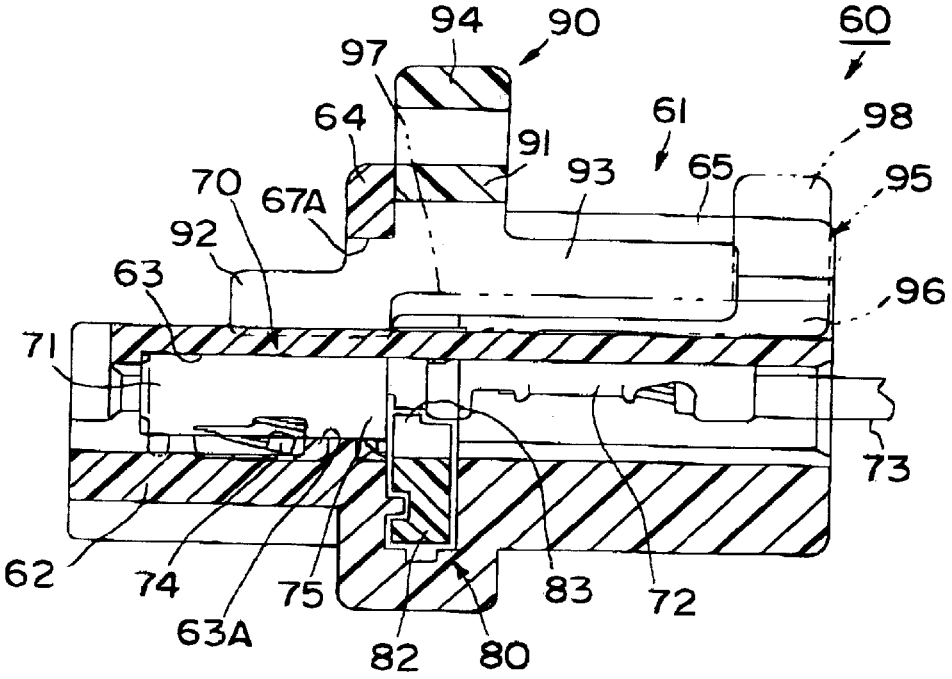
FIG. 11 is a vertical section of the second embodiment when a retainer, a connection detecting member and a short releasing member are partly locked.

Before the connector housings 11, 21 are connected, the male tabs 13 are shorted by the shorting fitting 14 in the male connector 10 (see FIG. 4). The female connector 20 is assembled in the following manner and is fitted or fittable into the male connector 10. Specifically, the retainer 40 is substantially fitted into the mount portion 24 of the female connector housing 21, preferably from behind, and is held in the partial lock position by the unillustrated locking means, and the connection detecting member 55 is mounted in its partial lock position. In this state, the female terminal fittings 30 are inserted into the cavities 23 and primary locking is effected on the female terminal fittings 30 by the engagement of the metal locking portions 34 and the primary locking portions 23A (see FIG. 2).

Upon the primary locking of the female terminal fittings 30, the retainer 40 is displaced laterally (i.e. in a direction at an angle different from 0° or 180°, preferably substantially normal with respect to the insertion direction of the female terminal fittings 30 into the female connector housing 21), preferably upwardly to its full lock position (FIGS. 3 to 6) by operating the operable projection 43 in the hole 25D by finger. Then, the secondary locking portions 42 engage the receiving portions 35 of the female terminal fittings 30. With this second locking together with the aforementioned primary locking, the female terminal fittings 30 are doubly locked (see FIG. 3).

When the retainer 40 is displaced to the full lock position, the elastic lock portions 44 integral or unitary with the retainer 40 are displaced upward to such a height as to be at least partially engageable with the lock grooves 16 of the male connector housing 11. Further, the upper end open area of the through hole 41 of the retainer 40 is substantially aligned with the SRP through hole 25A of the female connector housing 21, with the result that this through hole 25A is open such that the short releasing portion 52 can be inserted therethrough.

When the female terminal fittings 30 are insufficiently inserted, the retainer 40 cannot be displaced to its full lock position even if an attempt is made to push up the retainer 40 in its partial lock position because the secondary locking portions 42 are interfered substantially by the lower surfaces of the terminal main bodies 31. In this way, the insufficient insertion of the female terminal fittings 30 is detected. In such a case, the female terminal fittings 30 are reinserted to their proper insertion positions and then the retainer 40 is displaced to its full lock position.

Subsequently, the female connector housing 21 is fitted into the male connector housing 11 with the connection detecting member 55 in its partial lock position. In this state, the connection detecting portions 57 are located above the elastic lock portions 44, which are permitted to be elastically deformed to the unlock positions. Accordingly, the elastic lock portions 44 enter the male connector housing 11 while undergoing an inward elastic deformation. When the connector housings 11, 21 are properly connected, the elastic lock portions 44 are engaged with the lock grooves 16, with the result that the connector housings 11, 21 are locked in their connected states (see FIG. 9). Thereafter, the connection detecting member 55 is pushed downwardly to the full lock position. Then, the connection detecting portions 57 enter the clearances between the elastic lock portions 44 and the housing main body 22, thereby preventing the elastic lock portions 44 from being displaced to their unlock positions. As a result, the connectors 11, 21 are doubly locked (see FIGS. 4 and 8).

In the case that the connector housings 11, 21 are connected only partly when the connection detecting member 55 is pushed down, the elastic lock portions 44 are displaced to their unlock positions and the clearances between them and the housing main body 22 are dimensioned such or are so narrow that the connection detecting portions 57 cannot enter. Therefore, the connection state of the connector housings 11, 21 can be detected based on whether or not the connection detecting member 55 can be displaced to its full lock position.

Preferably after the connector housings 11, 21 are locked in their proper connected states, the short releasing member 50 is mounted on the female connector housing 21. This operation is done by inserting the short releasing portion 52 into the SRP through hole 59 of the connection detecting member 55, the through hole 41 of the retainer 40 and the SRP through hole 25A of the female connector housing 21 preferably in this order and substantially from behind. When the short releasing member 50 is mounted in its full lock position, the short releasing portion 52 slips between the shorting fitting 14 and the male terminals 13 and elastically deforms the shorting fitting 14 laterally, preferably upwardly. As a result, the shorting fitting 14 is disengaged from the male tabs 13, thereby releasing the shorted state of the male tabs 13.

If the retainer 40 is in its partial lock position when the short releasing member 50 is mounted, the SRP through hole 25A of the female connector housing 21 is at least partially closed and, accordingly, the short releasing member 50 cannot be pushed to its full lock position. In this case, the inserted states of the female terminal fittings 30 need to be confirmed because of a possibility that they are insufficiently inserted.

When the connectors are to be disconnected from each other, the short releasing member 50 is first detached from the female connector housing, thereby permitting the male tabs 13 to be shorted by the short fitting 14. Subsequently, the connection detecting member 55 is raised to its partial lock position, thereby permitting the elastic deformation of the elastic lock portions 44. Thereafter, if a force is applied to separate the connector housings 11, 21 from each other, the elastic lock portions 44 are disengaged from the lock grooves 16 while undergoing elastic deformation, with the result that the connector housings 11, 21 are disengaged.

As described above, in this embodiment, the short releasing portion 52 for releasing the shorted state of the male tabs 13 of the male connector housing 11 and the connection detecting portions 57 for detecting the connected state of the connector housings 11, 21 are formed on the short releasing member 50 and the connection detecting member 55, respectively which are separate members. Accordingly, the short releasing operation and the connection detection can be performed at desired timings. Thus, when the connectors 10, 20 are to be connected, the shorted state of the male tabs 13 can be released by the short releasing portion 52 after the proper connection of the connector housings 11, 21 is confirmed by the connection detecting portions 57. Further, when the connectors 10, 20 are to be disconnected, the male tabs 13 can securely be shorted by detaching the short releasing portion 52 before the connection detecting portions 57 are disengaged from the elastic lock portions 44 to disengage the connector housing 11, 21.

A second embodiment of the invention is described with reference to FIGS. 10 to 14. Since a male connector 10 into which a female connector 60 of this embodiment is fitted has the same or similar construction as that of the first embodiment, no description is given thereon.

The female connector 60 is comprised of a female connector housing (connector housing) 61, female terminal fittings 70, a retainer 80, a connection detecting member 90 and a short releasing member 95.

The female connector housing 61 includes a housing main body 62 formed with at least one pair of cavities 63, a first mount portion 64 formed in a substantially middle portion of the housing main body 62 with respect to forward and backward directions, and a second mount portion 65 which is so formed as to substantially enclose or extend along a rear half area of the housing main body 62. The female terminal fittings 70 are inserted or insertable into the cavities 63 preferably through their rear end openings, and a primary locking portion 63A engageable with the female terminal fitting 70 is formed preferably in each cavity 63.

The interior of the first mount portion 64 defines a space which is open in one side surface and substantially communicates with the cavities 63. The retainer 80 is to be accommodated in this space. A forwardly projecting elastic lock portion 66 is formed integrally or unitarily on the front surface of the first mount portion 64 for locking the connector housings 11, 61 into each other. A lock claw 66A is formed at the projecting end of the elastic lock portion 66 and projects outwardly therefrom. This lock claw 66A has a comblike or curved shape when viewed from front and is positioned such that an arc defined by the lock claw 66A preferably has the substantially same center as an arc defined by a lock claw 84A of an elastic lock portion 84 of the retainer 80 to be described later. Such an elastic lock portion 66 is in a lock position where it is engageable with the lock groove 16 when it is in its free state and is displaceable to an unlock position where it is disengaged from the lock groove 16 by being elastically deformed inwardly. The first mount portion 64 is formed with a short releasing portion (SRP) through hole 67A which substantially extends in forward and backward directions preferably along the upper surface of the housing main body 62 and connection detecting portion (CDP) through holes 67B which substantially extend along forward and backward directions preferably along the substantially opposite side surfaces of the housing main body 62.

The lateral, preferably upper surface of the second mount portion 65 is recessed in its middle part with respect to transverse direction. Connection detecting portion (CDP) through holes 67C are defined substantially between the opposite side surfaces of the second mount portion 65 and the outer side surfaces of the housing main body 62.

Each female terminal fitting 70 includes a substantially box-shaped terminal main body 71 to be inserted into the corresponding cavity 63 and a wire connection portion 72 extending substantially backwardly from the rear end of the terminal main body 71. A wire 73 is connected with the wire connection portion 72 e.g. by cramping. On the lower surface of the terminal main body 71 is formed a metal lance or locking portion 74 that is engageable with the primary locking portion 63A of the cavity 63. A lower portion of the rear end surface of the terminal main body 71 acts as a receiving portion 75 engageable with the retainer 80 for effecting secondary locking.

The retainer 80 includes a main body 81 and an arm 82 that projects sideways (or in a direction at an angle different from 0° or 180° with respect to an insertion direction of the female terminal fitting 70 into the housing 21) from the bottom end of the main body 81. The projecting end substantially hangs free. A secondary locking portion 83 that is engageable with the receiving portion 75 of the female terminal fitting 70 is formed on the upper surface of the arm 82. The retainer 80 is selectively mountable by at least partially inserting the arm 82 sideways into the first mount portion 64 in a partial lock position (not shown), where it is inserted halfway, and in a full lock position (see FIG. 14) where it is deeply inserted.

Such a retainer 80 is integrally or unitarily formed with the elastic lock portion 84 for locking the connector housings 11, 61 in their connected state. The elastic lock portion 84 projects forwardly from the main body 81 and is elastically deformable inwardly. The lock claw 84A is formed at the projecting end of the elastic lock portion 84. This lock claw 84A has a comblike shape when viewed from front. With the retainer 80 fully locked, the lock claw 84A and the lock claw 64A of the elastic lock portion 66 of the female connector housing 61 are preferably positioned on substantially concentric circles.

The connection detecting member 90 includes a main body 91, a pair of connection detecting portions 92 extending forwardly from the opposite side edges of the main body 92, and guide portions 93 extending substantially backwardly preferably from the opposite side edges of the main body 92. The connection detecting member 90 is mounted by inserting the connection detecting portions 92 into the CDP through holes 67B to the extent that the main body 91 comes substantially into contact with the rear surface of the upper end of the first mount portion 64, and is displaceable between a partial lock position (see FIG. 11) where a raised portion 94 of the main body 91 projects substantially upwardly from the first mount portion 64 and a full lock position (see FIGS. 12 to 14) which is located substantially below the partial lock position. With the connection detecting member 90 in its partial lock position, the connection detecting portions 92 are located substantially above the elastic lock portions 66, 84, thereby permitting their displacements or deflections to their unlock positions. When the connection detecting member 90 is moved to its full lock position, the connection detecting portions 92 enter clearances between the elastic lock portions 66, 84 and the side surfaces of the housing main body 62, thereby substantially preventing the displacements or deflections of the elastic lock portions 66, 84 to their unlock positions.

The short releasing member 95 includes a main body 96 and a substantially plate-shaped short releasing portion 97 extending forwardly from the main body 96. A raised or projecting portion 98 is formed on the upper surface of the main body 96. Such a short releasing member 95 is mounted with the short releasing portion 97 substantially aligned along the lateral, preferably upper surface of the housing main body 62 and is displaceable substantially along forward and backward directions between a partial lock position where the front end of the short releasing portion 97 is located behind or at the SRP through hole 67A of the female connector housing 61 and a full lock position where the short releasing portion 97 projects forward to a large extent through the through hole 67A.

Figure 12:
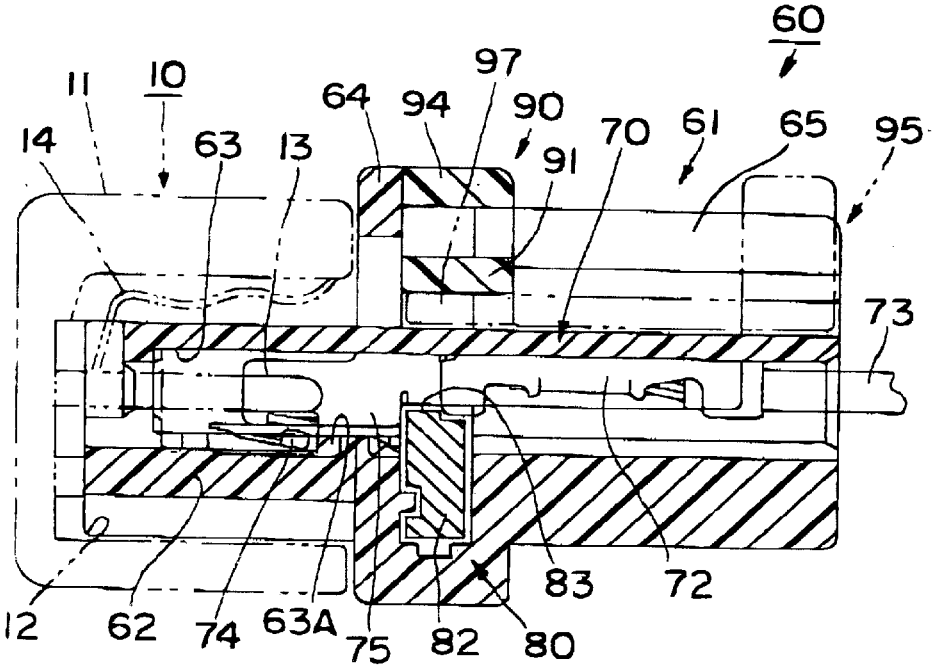
FIG. 12 is a vertical section of the second embodiment when the retainer and the connection detecting member are fully locked and the short releasing member is partly locked.
Figure 13:
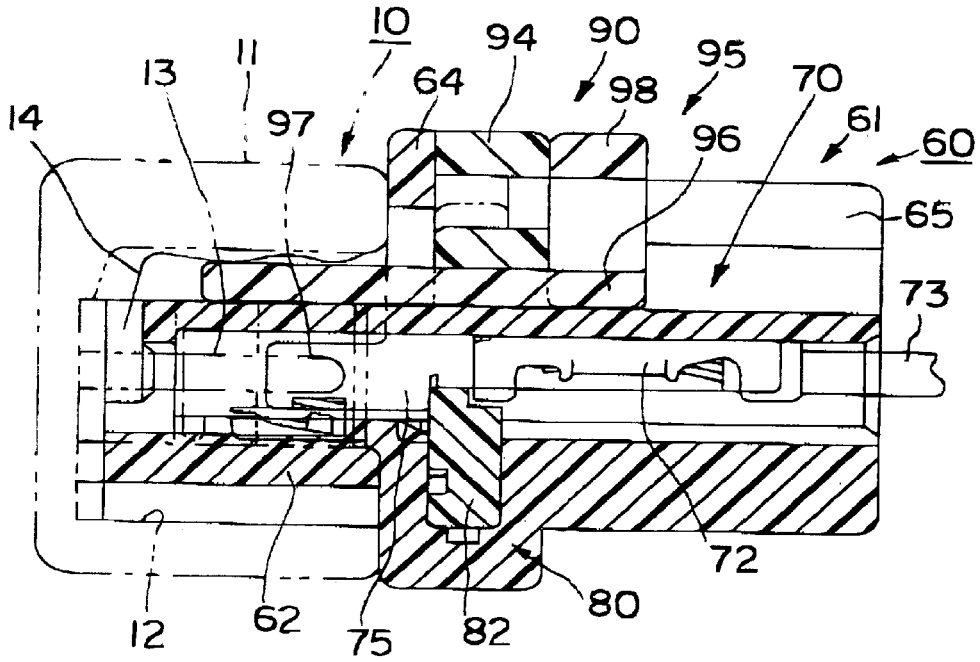
FIG. 13 is a vertical section of the second embodiment when the retainer, the connection detecting member and the short releasing member are fully locked.
Figure 14:
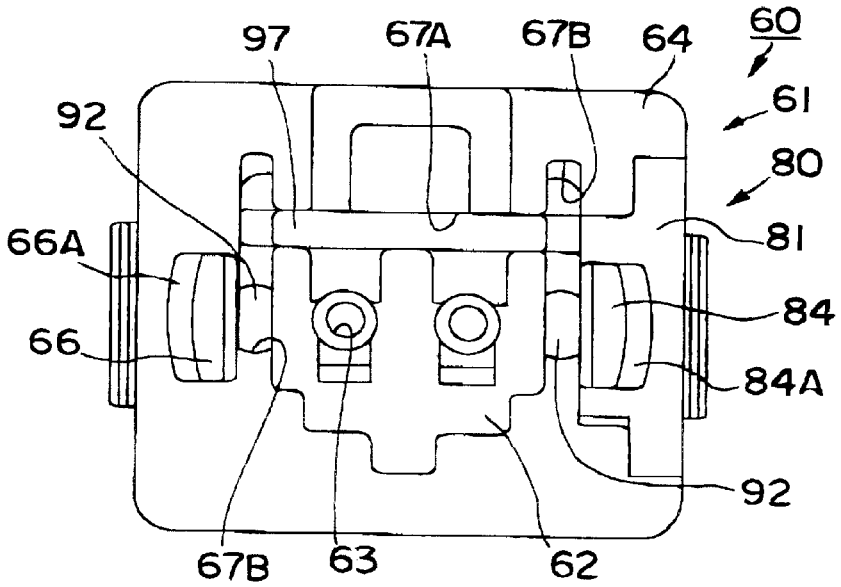
FIG. 14 is a front view of the second embodiment when the retainer and the connection detecting member are fully locked.
Figure 15:
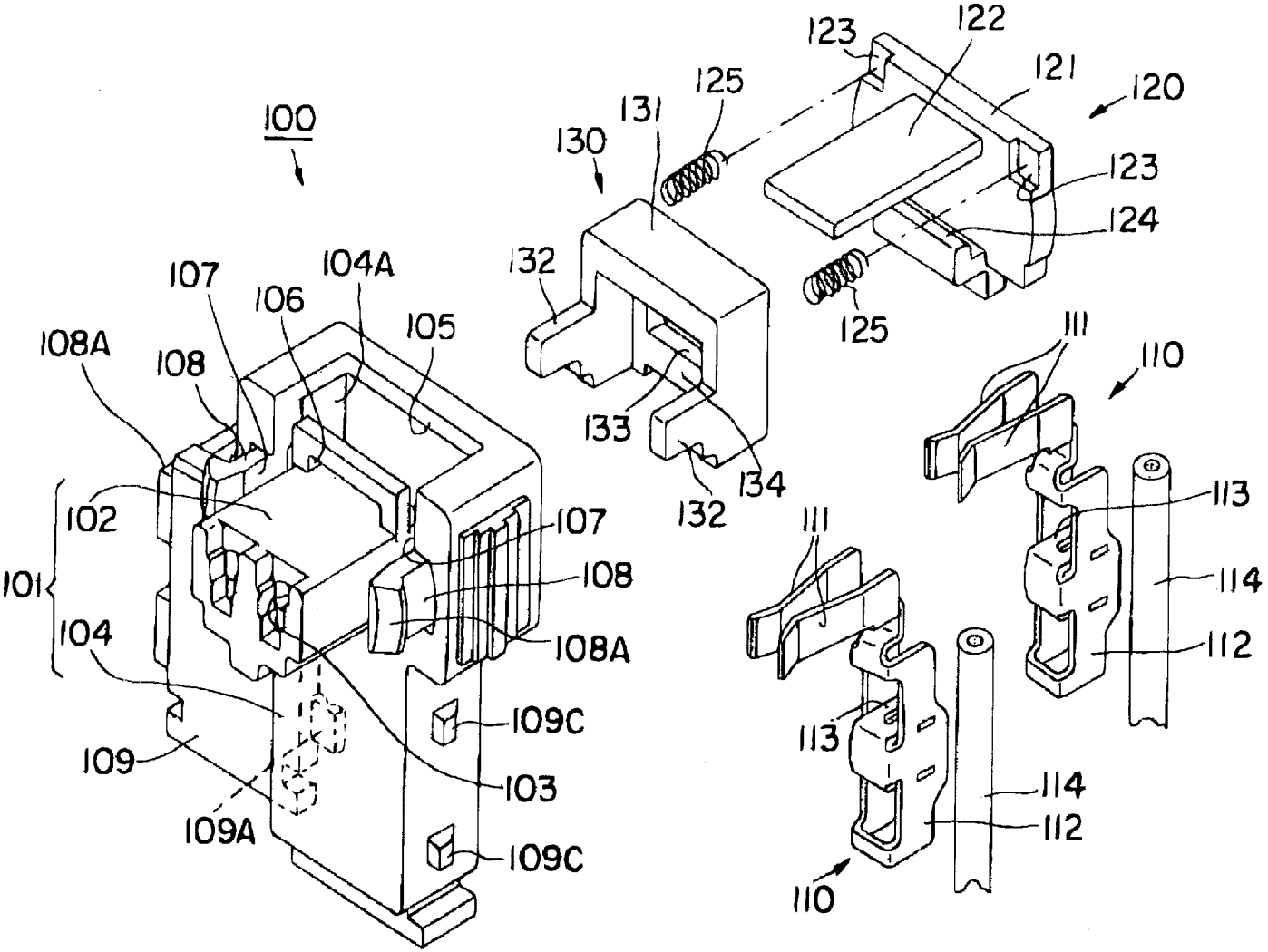
FIG. 15 is an exploded perspective view of a third embodiment.
Figure 16:
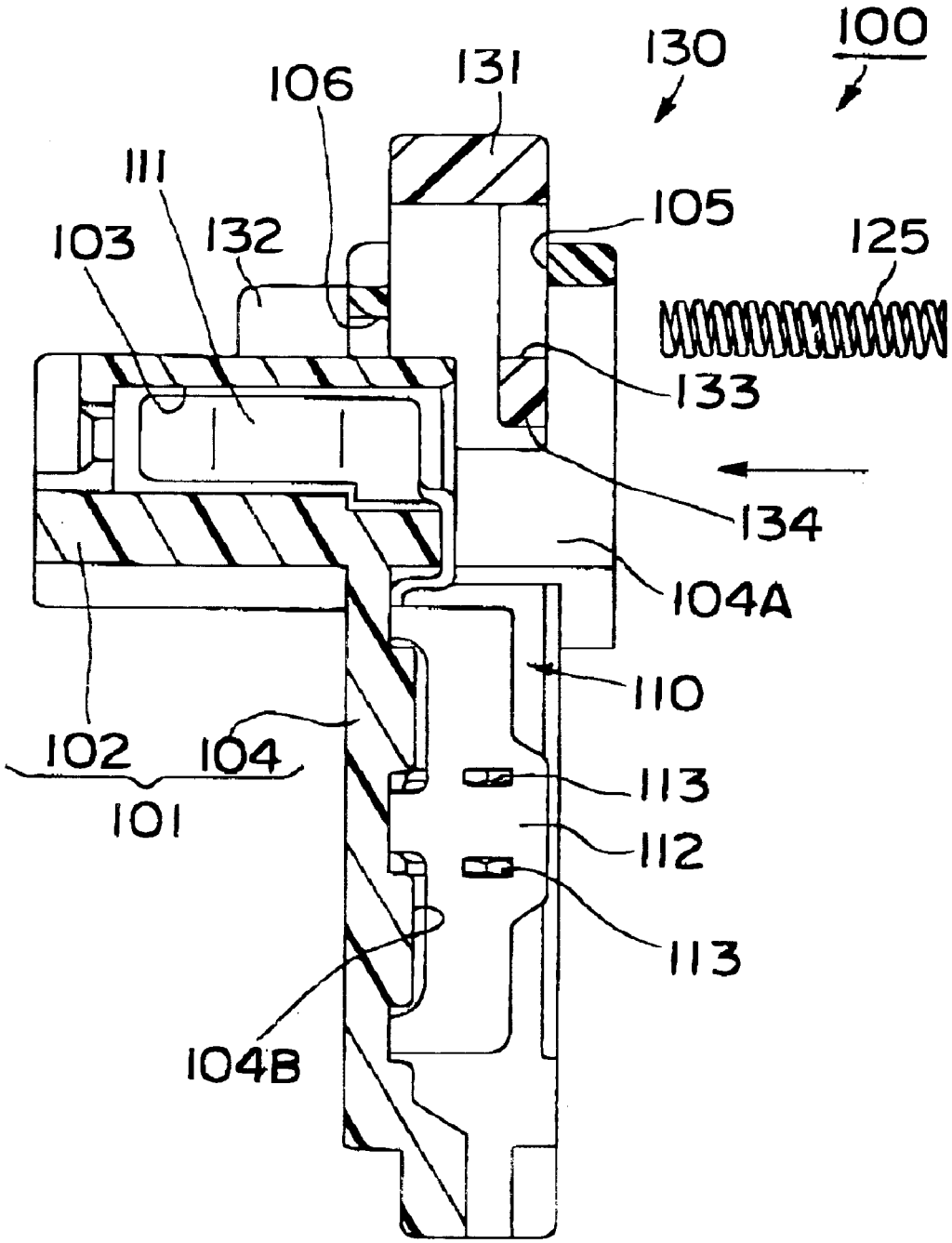

With the connector housings 11, 61 unconnected, the male tabs 13 are shorted by the shorting fitting 14 in the male connector 10 (see FIG. 12).

On the other hand, the female connector 60 is assembled and connected with the male connector 10 in the following procedure. Specifically, the retainer 80, the short releasing member 95 and the connection detecting member 90 are mounted on the female connector housing 61 in their respective partial lock positions (see FIG. 11). In this state, the secondary locking portions 83 are displaced substantially sideways from the cavities 63 and, accordingly, the female terminal fittings 70 can be inserted into the cavities 63.

After the insertion of the female terminal fittings 70, the retainer 80 is pushed to its full lock position. At this time, if the female terminal fittings 70 are insufficiently inserted the side surfaces of the terminal main bodies 71 will interfere with the secondary locking portions 83. Thus, the retainer 80 cannot be displaced to its full lock position. In other words, the inserted state of the female terminal fittings 70 can be detected based on whether or not the retainer 80 can be pushed to its full lock position.

After the displacement of the retainer 80 to its full lock position, the connector housings 11, 61 are or can be connected. At this time, since the connection detecting member 90 is in its partial lock position and the connection detecting portions 92 are located above the elastic lock portions 66, 84, the connection smoothly progresses while the elastic lock portions 66, 84 are being displaced or deflected substantially to their unlock positions. When the connector housings 11, 61 are substantially properly connected, the elastic lock portions 66, 84 are engaged with the lock grooves 16, with the result that the connector housings 11, 61 are locked in their properly connected state.

Thereafter, the connection detecting member 90 is pushed to its full lock position (see FIG. 12). Then, the connection detecting portions 92 enter the clearances between the elastic lock portions 66, 84 and the housing main body 62, thereby preventing the elastic lock portions 66, 84 from being displaced or deflected to their unlock positions (see FIG. 14). As a result, the connector housings 11, 61 are doubly locked. In the case that the connector housings 11, 61 are partly connected, the elastic lock portions 66, 84 are in their unlock positions by the interference with the inner wall surfaces of the male connector housing 11. Accordingly, the connection detecting portions 92 cannot enter the clearances between the elastic lock portions 66, 84 and the housing main body 62 and the connection detecting member 90 cannot be displaced to its full lock position. In other words, the connected state of the connector housings 11, 61 can be detected based on whether or not the connection detecting member 90 can be displaced to its full lock position.

Thereafter, the short releasing member 95 is displaced to its full lock position. Then, the short releasing portion 97 slips under the shorting fitting 14 to separate it from the male tabs 13, with the result that the shorted state of the male tabs 13 is released (see FIG. 13).

When the connectors 10, 60 are to be disconnected, the short releasing member 95 is displaced to its partial lock position to short the male tabs 13 (see FIG. 12). Next, the connection detecting member 90 is raised to its partial lock position to permit the elastic deformation of the elastic lock portions 66, 84. Thereafter, if a force is applied to separate the connector housings 11, 61 from each other, the elastic lock portions 66, 84 are disengaged from the lock grooves 16 while undergoing elastic deformation, with the result that the connector housings 11, 61 are disengaged.

Since the effects of the second embodiment are substantially same as those of the first embodiment, no description is given.

A third embodiment of the invention is described with reference to FIGS. 15 to 21. No description is given on a male connector 10 with which a female connector 100 of this embodiment is to be connected since it has the same construction as those of the foregoing embodiments.

The female connector 100 is comprised of a female connector housing (connector housing) 101, a female terminal fitting 110, a short releasing member 120 and a connection detecting member 130.

The female connector housing 101 includes a housing main body 102 formed with one or more, preferably a pair of cavities 103, and a substantially box-shaped mount portion 104 substantially continuous with the rear end of the housing main body 102 and extending laterally, preferably downward. An upper area of the mount portion 104 acts as a mount space 104A, whereas a lower area thereof acts as a press space 104B. The spaces 104A, 104B are open preferably substantially entirely at the rear side of the mount portion 104. Elastic contact portions 111 of the female terminal fittings 110 are to be at least partially accommodated in the cavities 103; wire connection portions 112 thereof are to be pressed or inserted into the press space 104B; and the short releasing member 120 and the connection detecting member 130 are to be substantially accommodated in the mount space 104A. A connection detecting member (CDM) mount hole 105 is formed in the upper surface of the mount portion 104 and substantially communicates with the mount space 104A. In the front surface of the mount portion 104 are formed a short releasing portion (SRP) through hole 106 which is open substantially along the upper surface of the housing main body 102, and a pair of left and right connection detecting portion (CDP) through holes 107 which are open along the side surfaces of the housing main body 102.

A pair of left and right elastic lock portions 108 project from the front surface of the mount portion 104 so as to extend preferably substantially along the outer edges of the CDP through holes 107. Lock claws 108A project outwardly at the projecting ends of the elastic lock portions 108. Such elastic lock portions 108 are in their lock positions where they are engageable with the lock grooves 16 when they are in their free states and are displaceable to their unlock positions where they are substantially disengaged from the lock grooves 16 by being elastically deformed inward. When the elastic lock portions 108 are in their lock positions, there are defined spaces between them and the side surfaces of the housing main body 102 into which connection detecting portions 132 to be described later are at least partially insertable. However, when the elastic lock portions 108 are displaced to their unlock positions, the clearances between the elastic lock portions 108 and the housing main body 102 become so narrow or dimensioned that the connection detecting portions 132 cannot enter.

A press cover 109 is connected with the female connector housing 101 via a hinge 109A so as to be located preferably located at the left side when viewed from front. The press cover 109 is mounted on the female connector housing 101 to cover the press space 104 substantially by folding back the hinge 109A while bending it, and is locked in its mount position by engaging lock holes 109B of the press cover 109 with lock projections 109C of the female connector housing 101. Wire pressing portions 109D and escape recesses 109E are formed on a surface of the press cover 109 which is located inside when the press cover 109 is mounted. Blades 113 of the female terminal fittings 110, to be described later, substantially enter the escape recesses 109E, and the wire pressing portions 109D press wires 114 toward the blades 113. In other words, the wires 114 preferably are connected with female terminal fittings 110 by mounting the press cover 109 on the female connector housing 101.

The female terminal fittings (cramping terminal) 110 include each a pair of left and right elastic contact portions 111 to be insertable into the cavities 103 and the substantially box-shaped wire connection portion 112 extending preferably downward from the rear end of the elastic contact portions 111. The wire connection portion 112 is opened at its rear side, and the blades 113 to be connected with the corresponding wire 114 by cramping are formed inside the wire connection portion 112. The blades 113 are connected with the wire 114 by the press cover 109 as described above.

Figure 17:
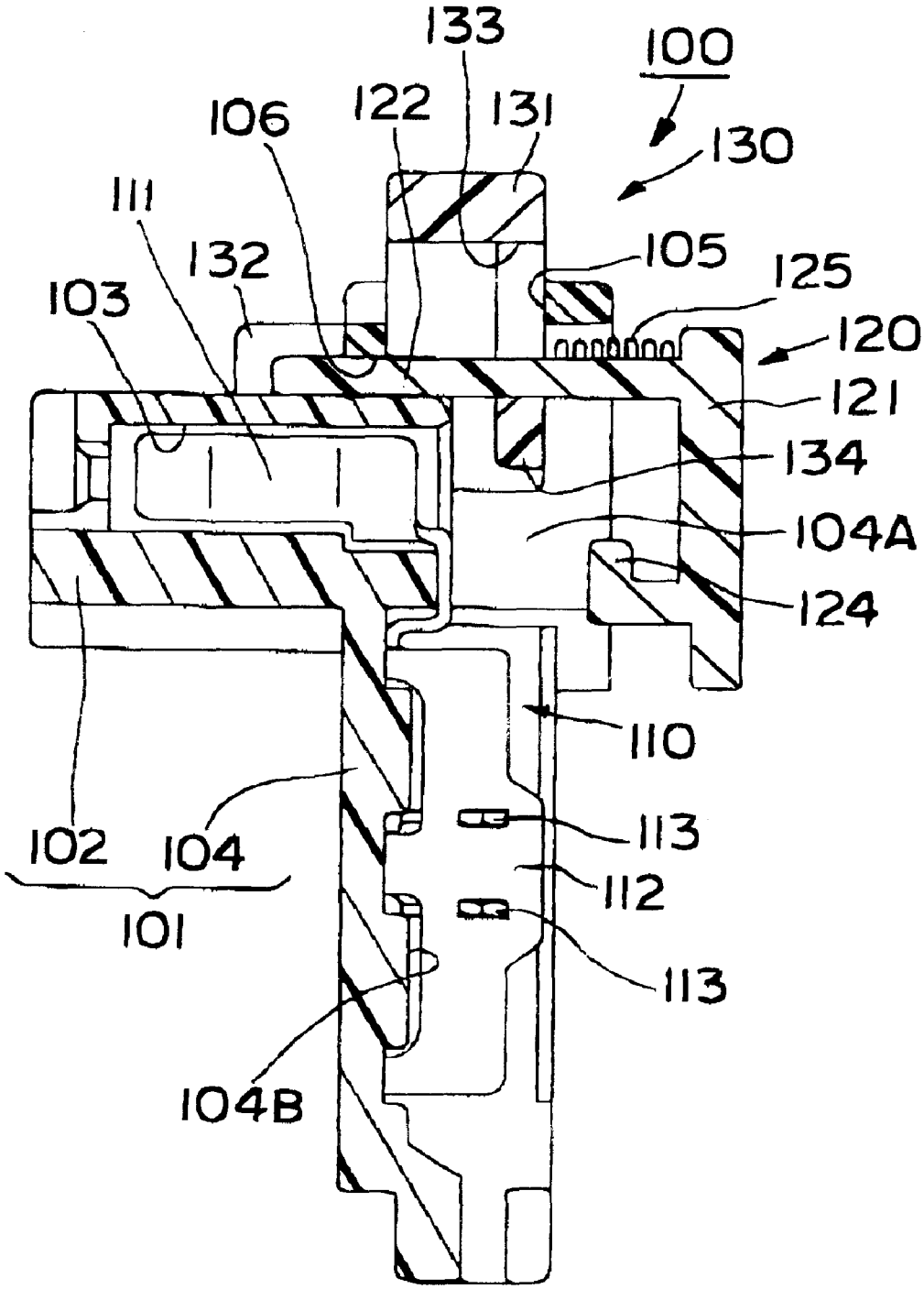
FIG. 17 is a vertical section of the third embodiment when return springs are mounted and a short releasing member is partly locked in the state of FIG. 16.
Figure 18:
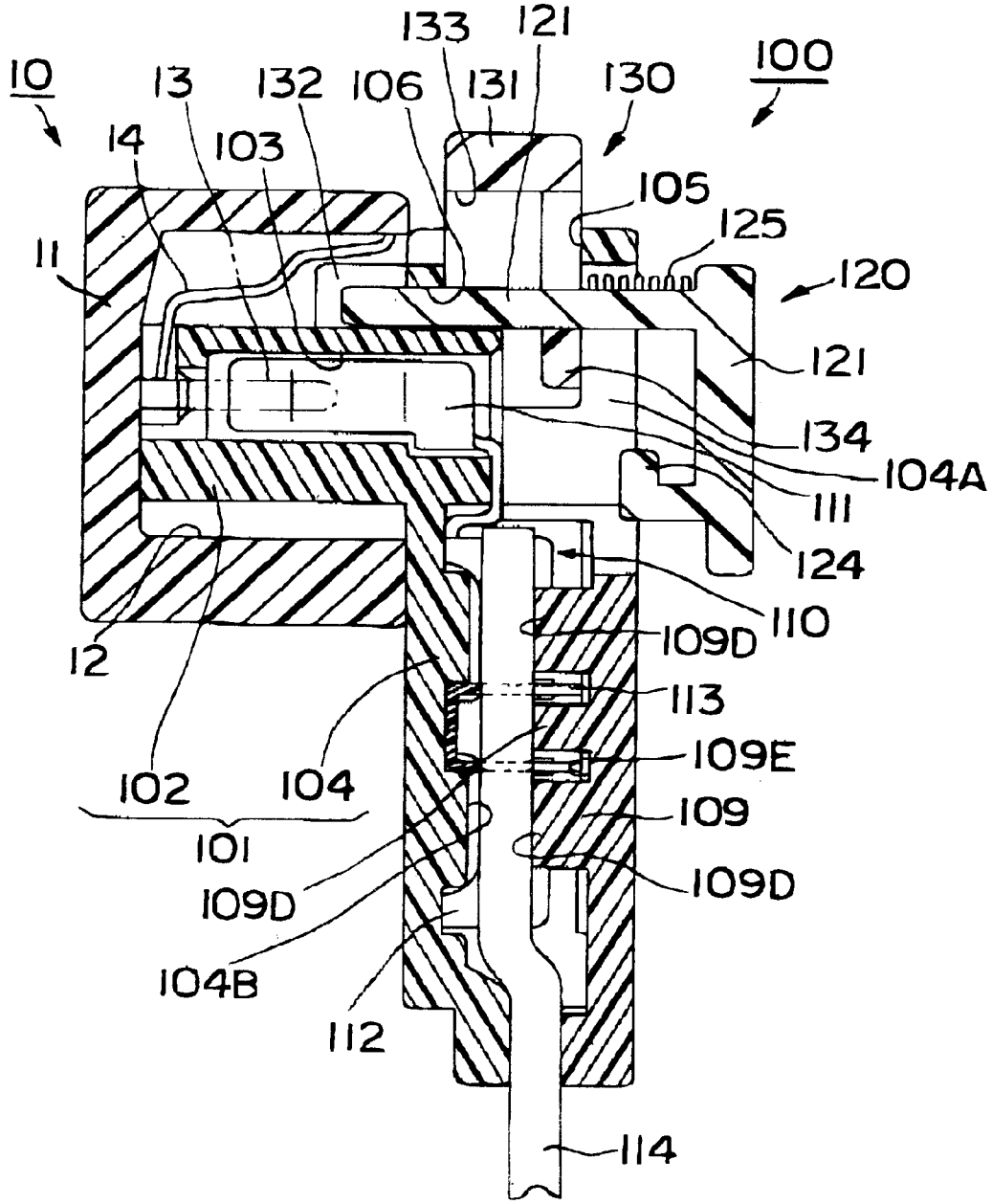
FIG. 18 is a vertical section of the third embodiment when wires are connected by cramping and a cover is assembled with a male connector housing in the state of FIG. 17.
Figure 19:
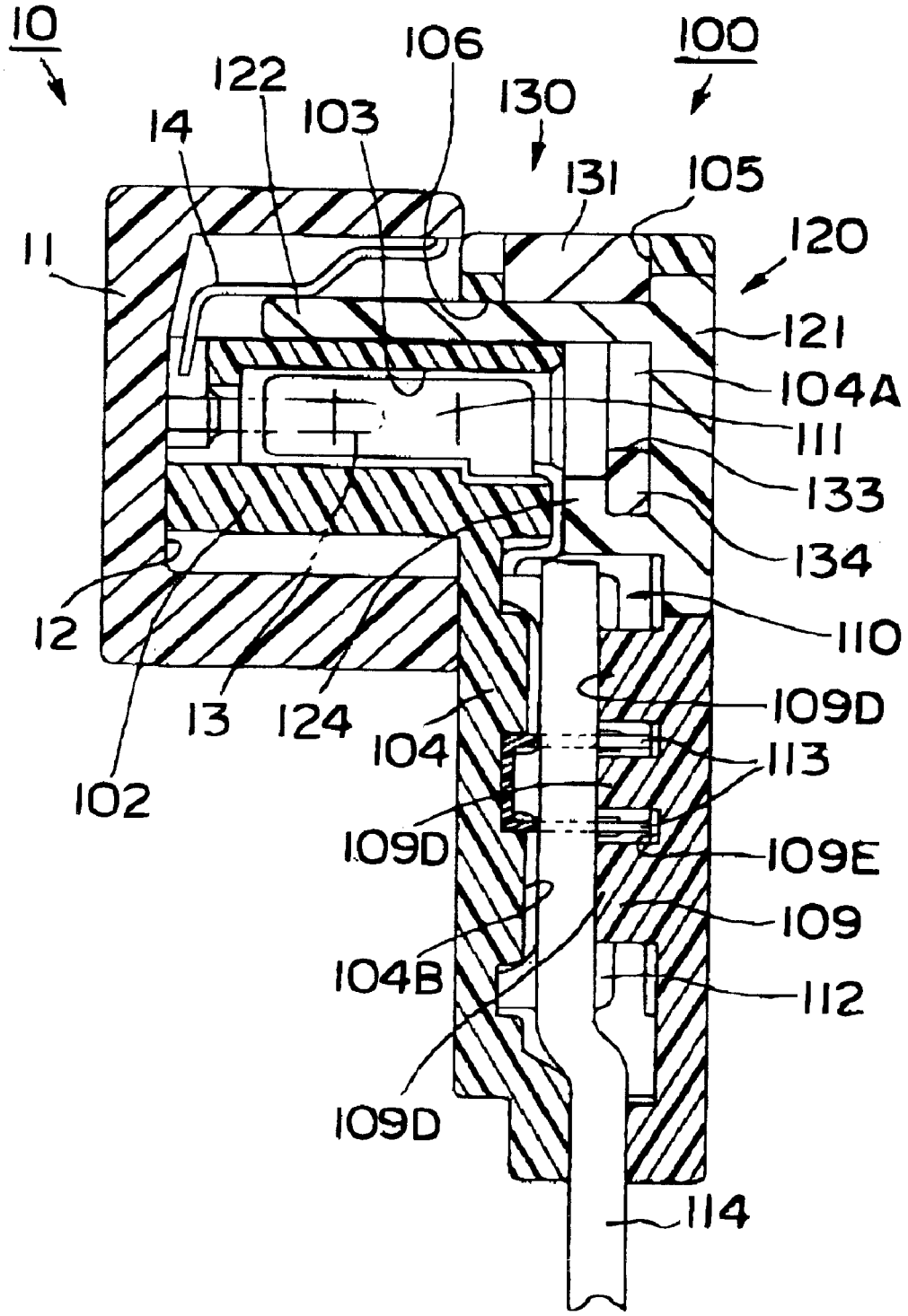
FIG. 19 is a vertical section of the third embodiment when the short releasing member and the connection detecting member are fully locked in the state of FIG. 18.
Figure 20:
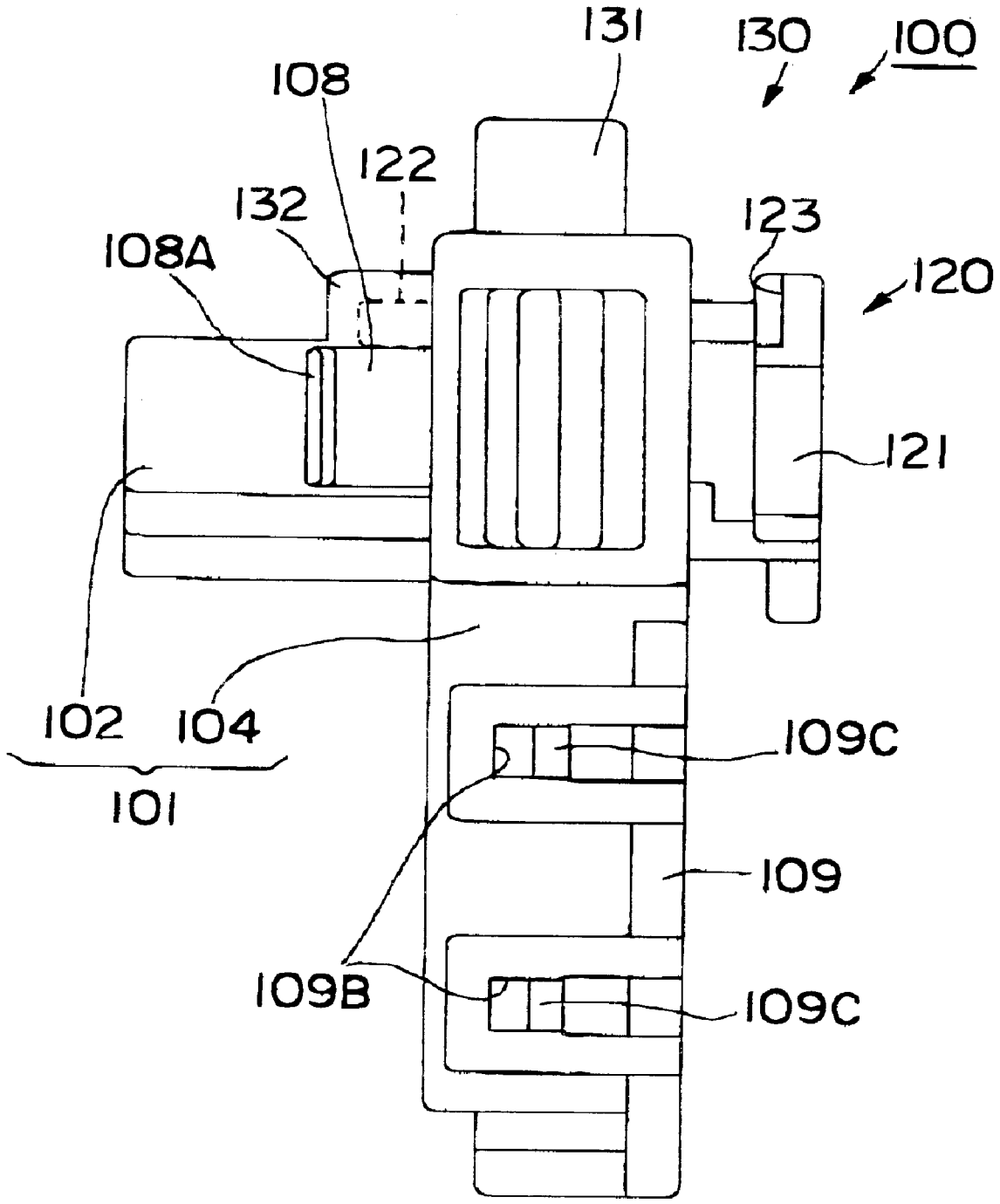
FIG. 20 is a side view showing the state of FIG. 18.
Figure 21:
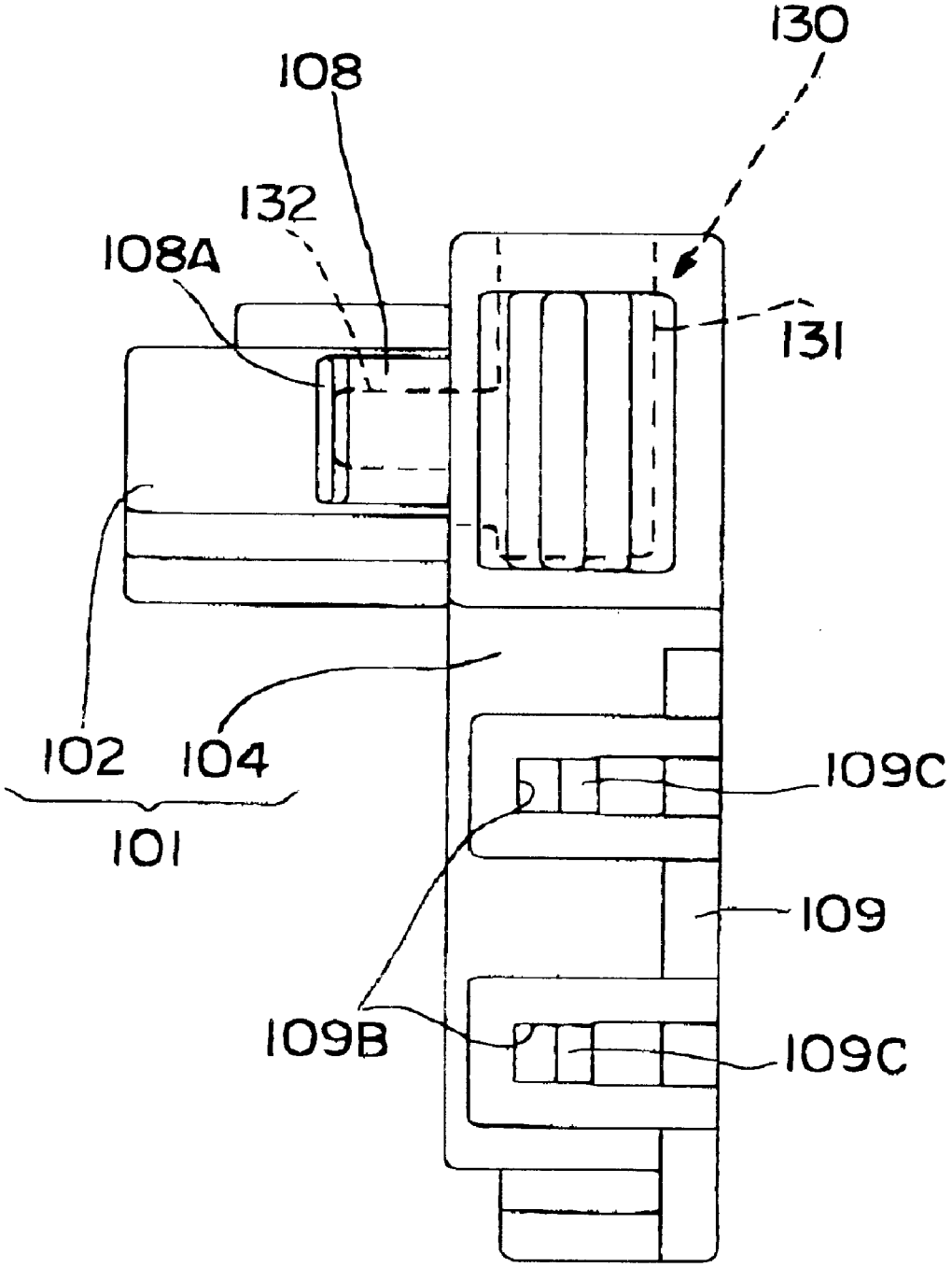
FIG. 21 is a side view showing the state of FIG. 19.

The short releasing member 120 includes a main body 121 which preferably is plate-shaped as a whole, and a short releasing portion 122 which extends horizontally (or substantially along a direction of insertion of the female and male connectors 100, 10) from the front surface of the main body 121, such that the projecting end substantially hangs free. The short releasing member 120 is inserted or insertable into the mount space 104A preferably from behind the female connector housing 101 and is mountable in a partial lock position where the main body 121 projects backward of the female connector housing 101 as shown in FIGS. 17 and 18 and in a full lock position where the main body 121 is substantially flush with the rear surface of the female connector housing 101. The short releasing member 120 is held in its partial lock position by an unillustrated locking means and is securely held in its full lock position by the engagement with the connection detecting member 130 (FIG. 19) as described later.

With the short releasing member 120 partly locked, the short releasing portion 122 projects forward a short distance from the SRP through hole 106. Accordingly, the short releasing portion 122 is substantially not touching or not deflecting the shorting fitting 14 when the connector housings 11, 101 are connected. However, since the short releasing portion 122 projects a long distance with the short releasing member 120 in its full lock position, it engages the shorting fitting 14 when the connector housings 11, 101 are connected, thereby deforming the shorting fitting 14 upward and/or away from the male tabs 13.

The upper corners of the front surface of the main portion 121 of the short releasing member 120 are recessed to form a pair of left and right spring receiving portions 123. One end of each compression coil spring (biasing means) 125 is brought into contact with the spring receiving portion 123. The compression coil springs 125 preferably are arranged substantially along the opposite side surfaces of the connection detecting member 130, and the other ends of the compression coil springs 125 are brought into contact with unillustrated spring receiving portions in the mount space 104A. By the compression coil springs 125, the short releasing member 120 is biased in a direction from its full lock position to its partial lock position (a direction opposite from a mounting direction).

The connection detecting member 130 includes a substantially box-shaped main body 131 having substantially open front and lower surfaces and a pair of left and right connection detecting portions 132 projecting forwardly from the side edges of the main body 131, such that the projecting ends substantially hang free. A SRP through hole 133 is formed in the rear surface of the main body 131. The connection detecting member 130 is mounted or mountable on the female connector housing 101 by fitting or inserting the main body 131 into the CDM mount hole 105 from above and by inserting the connection detecting portions 132 into the CDP through holes 107. The connection detecting member 130 is held by an unillustrated locking means in its partial lock position (see FIGS. 16 to 18) and its full lock position (see FIG. 19) located below the partial lock position.

The elastic lock portions 108 are permitted to be elastically deformed to their unlock positions in the partly locked state of the connection detecting member 130, since the connection detecting portions 132 are located spaced or at a distance, preferably substantially above the elastic lock portions 108. On the other hand, in the fully locked state of the connection detecting member 130, the displacement of the elastic lock portions 108 to their unlock positions is restricted, since the connection detecting portions 132 are located substantially overlapping with, preferably at the substantially same height as the elastic lock portions 108. It should be noted that the height of the SRP through hole 133 is such that the connection detecting member 130 is out of contact when the short releasing portion 122 is in any position between the partial lock position to the full lock position.

The third embodiment provides a means for holding the short releasing member 120 in its full lock position. Specifically, a bottom end of the main body 131 of the connection detecting member 130 acts as an engaging portion (holding means) 134 engageable with the short releasing member 120. On the other hand, the main body 121 of the short releasing member 120 is formed with a substantially L-shaped receiving portion 124 projecting from a bottom part of its front surface. The engaging portion 134 is engageable with this receiving portion 124.

When the short releasing member 120 and the connection detecting member 130 are both in their partial lock positions, the engaging portion 134 is positioned obliquely forward or not corresponding to or substantially flush with respect to the receiving portion 124. If the short releasing member 120 is moved forward to its full lock position with the connection detecting member 130 left in its partial lock position, the receiving portion 124 is located substantially below or substantially corresponding to or substantially flush with the engaging portion 134. The engaging portion 134 engages the receiving portion 124, if an attempt is made to move the connection detecting member 130 to its full lock position in this state, with the result that a backward (a direction returning to the partial lock position) displacement of the short releasing member 120 is prevented.

With the connector housings 11, 101 unconnected, both male tabs 13 are shorted by the shorting fitting 14 in the male connector 10. The female connector 100 is assembled in the following manner and fitted into the male connector 10. Specifically, the elastic contact portions 111 of the female terminal fittings 110 are at least partially inserted into the cavities 103 preferably from behind the female connector housing 101; the wire connecting portions 112 are pressed into the press spaces 104B; and the connection detecting member 130 is at least partially fitted into the CDM mount hole 105 preferably from above the female connector housing 101 and partly locked (see FIG. 16). Since the connection detecting portions 132 of the connection detecting member 130 partly locked are located above the elastic lock portions 108, the elastic lock portions 108 are elastically deformed inwardly, thereby being displaced to their unlock positions (see FIG. 20).

Next, the short releasing member 120 is partly locked (see FIG. 17) while the compression coil springs 125 are being inserted into the mount space 104A. At this time, the short releasing portion 122 passes through the SRP through holes 106, 133 of the connection detecting member 130 and the mount portion 104. The projecting length of the short releasing portion 122 is shorter than a length necessary to release the shorted state. The wires 114 are placed substantially along the rear surfaces of the wire connection portions 112. The press cover 109 is folded backward while the hinge 109A is bent, and the wires 114 are pushed into the inside of the wire connection portions 112 by the wire pressing portion 109D of the press cover 109 to be connected with the blades 113 (see FIG. 18). In this way, the assembling operation before the connection of the female connector 100 is substantially completed.

Next, this female connector 100 is connected with the male connector 10. Since the connection detecting portions 132 are located above the elastic lock portions 108 in this state, the elastic lock portions 108 enter the male connector housing 11 while being elastically deformed to their unlock positions. When the male and female connector housings 11, 101 are properly connected, the elastic lock portions 108 are engaged with the lock grooves 16, thereby locking the connector housings 11, 101 in their properly connected state (see FIG. 18). Since the short releasing portion 122 is substantially not touching or deflecting the shorting fitting 14 in this state, the male tabs 13 are kept shorted by the shorting fitting 14.

In this state, if the short releasing member 120 is pushed to its full lock position against the biasing forces of the compression coil springs 125, the short releasing portion 122 pushes the shorting fitting 14 up to release the shorted state of the male tabs 13. The short releasing member 120 is pushed to its full lock position without relaxing a force to push the short releasing member 120. Then, the engaging portion 134 of the connection detecting member 130 engages the receiving portion 124 of the short releasing member 120, with the result that the short releasing member 120 is held in its full lock position against the biasing forces of the compression coil springs 125 (see FIG. 19). Further, since the connection detecting portions 132 enter inside the elastic lock portions 108 (see FIG. 21) or substantially enter a space defined between the elastic lock portions 108 and the main body 102, the elastic deformation of the elastic lock portions 108 to their unlock positions is substantially prevented and the connector housings 11, 101 are thus locked in their properly connected state. This enables the detection of the proper connection of the connectors 10, 100. In this way, the connecting operation is completed.

If the connectors 10, 100 are connected only partly, the connector housings 11, 101 are not deeply fitted with each other. Thus, a distance from the leading end of the short releasing portion 122 to its engaging position with the shorting fitting 14 is longer as compared with a case where the connector housings 11, 101 are properly connected. Accordingly, the short releasing portion 122 does not substantially touch or deflect the shorting fitting 14 when the short releasing member 120 is pushed to its full lock position, and the male tabs 14 are kept shorted. Thereafter, if an attempt is made to push the connection detecting member 130 to its full lock position, the connection detecting member 130 cannot be displaced to its full lock position by the connection detecting portions 132 being interfered or interacting with by the elastic lock portions 108 since the elastic lock portions 108 are in their unlock positions. In this way, it is detected that the connectors 10, 100 are partly connected. At this time, the short releasing member 120 is pushed back to its partial lock position by the biasing forces of the compression coil springs 125.

Next, a case where the connection detection by the connection detecting member 130 is not made is described. Unless the connection detecting member 130 is pushed to its full lock position after the connectors 10, 100 are properly connected and the short releasing member 120 is pushed to its full lock position, the short releasing member 120 is pushed substantially back to its partial lock position by the biasing forces of the compression coil springs 125 if the short releasing member 120 is unhanded. In other words, whether or not the connection detecting member 130 has been pushed to the full lock position is or can be discriminated based on whether or not the short releasing member 120 is held in its full lock position.

As described above, the reason why the connection detecting member 130 cannot be pushed to its full lock position is either that the connectors 10, 100 are partly connected or that no attempt has been made to push it. In either case, this is caused by the improper assembling of the connectors 10, 100. On the other hand, whether or not the connection detecting member 130 has been pushed to its full lock position is discriminated based on whether or not the short releasing member 120 is held in its full lock position as described above. In other words, according to this embodiment, the assembled state of the connectors 10, 100 can be detected based on whether or not the short releasing member 120 can be held in its full lock position.

In the case of disconnecting the connectors 10, 100 properly assembled, the connection detecting member 130 is displaced to its partial lock position using a jig (not shown) or the like. Then, the elastic lock portions 108 are disengaged from the lock grooves 16 and the connection detecting member 130 is displaced to its partial lock position by the biasing forces of the compression coil springs 125, thereby shorting the male tabs 13. Thereafter, the connector housings 11, 101 are disconnected from each other.

Figure 22:
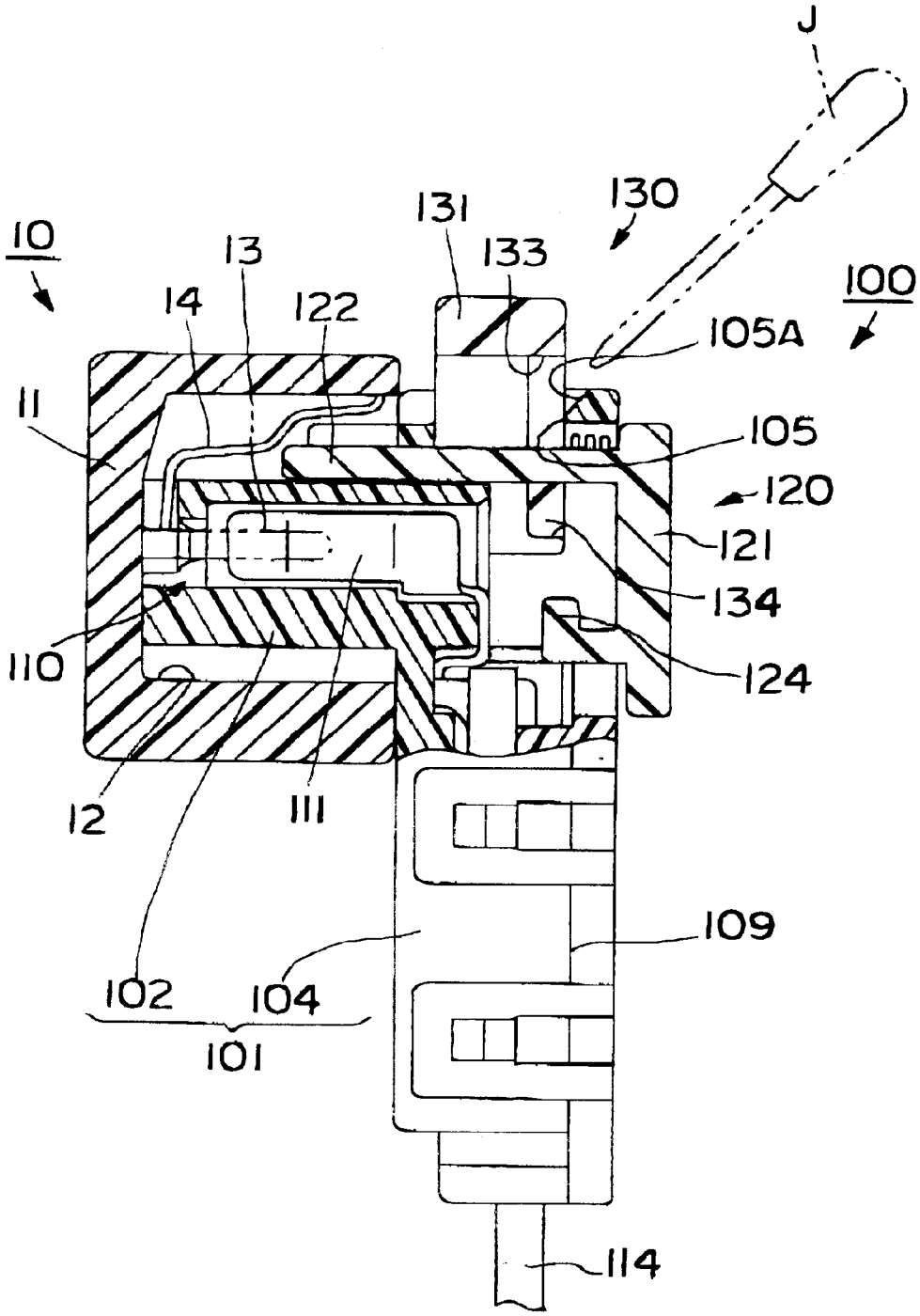
FIG. 22 is a vertical section of a fourth embodiment when a connection detecting member and a short releasing member are partly locked.
Figure 23:
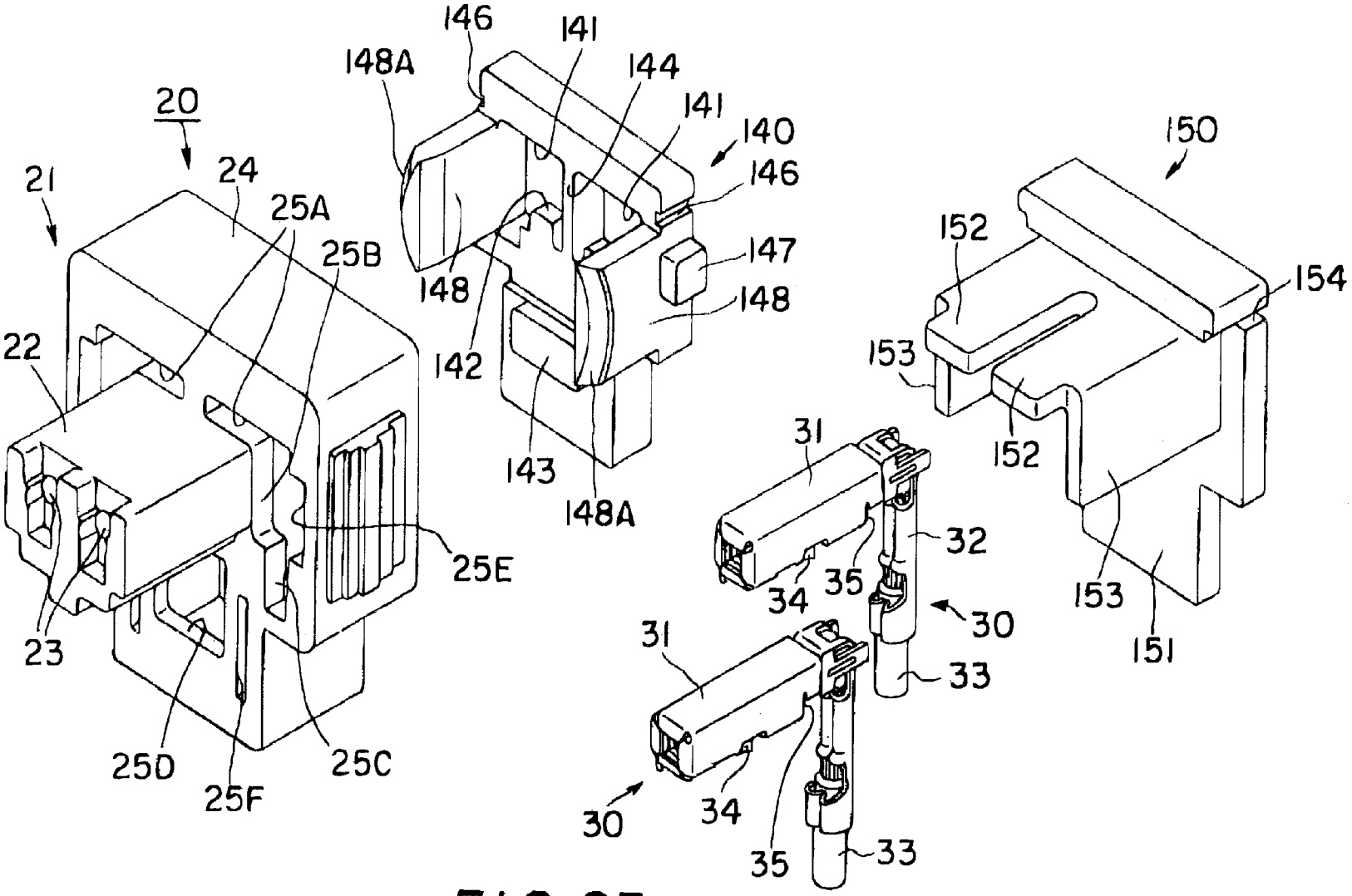
FIG. 23 is an exploded perspective view of a fifth embodiment.
Figure 24:
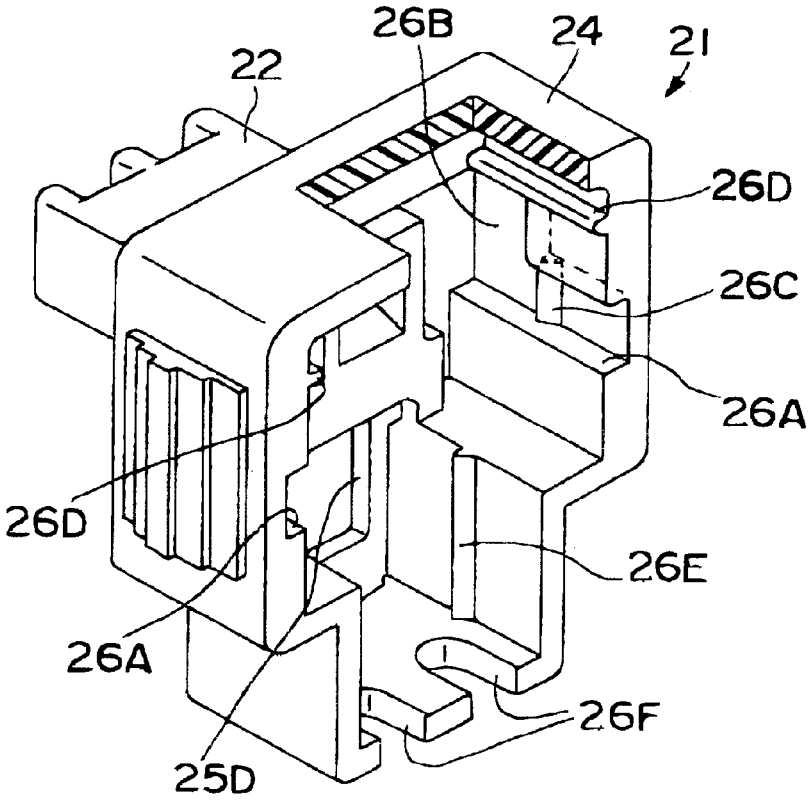
FIG. 24 is a perspective view partly in section of a female connector housing of the fifth embodiment.
Figure 25:
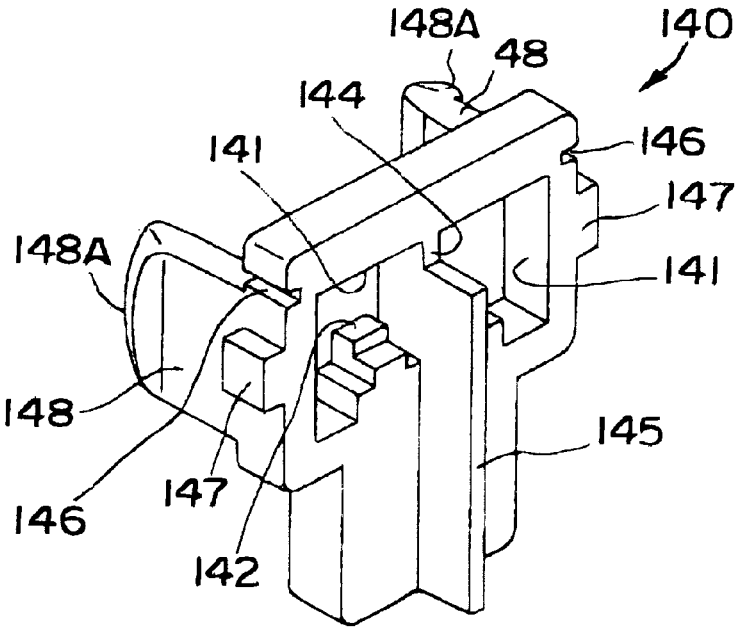
FIG. 25 is a perspective view of a retainer of the fifth embodiment.

A fourth embodiment of the invention is described with reference to FIG. 22. In the fourth embodiment, the partial lock position of the short releasing member 120 is different from that in the third embodiment. Specifically, when the connection detecting member 130 and the short releasing member 120 are both in their partial lock positions, the receiving portion 124 of the short releasing member 120 is located right below or corresponding to the engaging portion 134 of the connection detecting member 130, i.e. on a moving path of the engaging portion 134 when the connection detecting member 130 is displaced to. its full lock position. Accordingly, if an attempt is made to push the connection detecting member 130 to its full lock position without pushing the short releasing member 120 to its full lock position, the displacement of the connection detecting member 130 to its full lock position is prevented partway by the engaging portion 134 interfering with the upper surface of the receiving portion 124. In this way, the fourth embodiment can prevent the connection detection by the connection detecting member 130 from being made without releasing the shorted state of the male tabs 13 by the short releasing member 120.

Further, a notch 105A for the insertion of a jig J is formed at the edge of the CDM mount hole 105. The connection detecting member 130 can easily be displaced from its full lock position to its partial lock position by inserting the jig J into the notch 105A and levering the connection detecting member 130 with it.

A fifth embodiment of the invention is illustrated in FIGS. 23 to 33. In this embodiment, the female connector 20 is comprised of the female connector housing (connector housing) 21 to be connected with the male connector housing 11, female terminal fittings (terminal fittings) 30, a retainer 140 to be mounted on the female connector housing 21 and an engaging member 150 to be substantially mounted or mountable on the female connector housing.

The female connector housing 21 includes the housing main body 22 having a pair of cavities 23 formed side by side and a box-shaped mount portion 24 which is continuous with the rear end of the housing main body 22 and is widely open backward. The corresponding female terminal fitting 30 is inserted into each cavity 23 through an opening at its rear end, and a primary locking portion. 23A engageable with the female terminal fitting 30 is formed in the cavity 23.

The mount portion 24 is formed with a short releasing portion (SRP) through hole 25A which extends through the front wall of the mount portion 24 and is open along the upper surface of the housing main body 22. A pair of connection detecting portion (CDP) through holes 25B extend along side surfaces of the housing main body 22. A pair of elastic lock portion (ELP) through holes 25C extend along and communicate with the outer edge of the through holes 25B. These through holes 25A, 25B, 25C substantially communicate with each other.

In upper areas of the inner surfaces of the left and right surfaces of the mount portion 24 are formed partial lock guide portions 26A substantially extending in forward and backward directions and full lock guide portions 26B extending upwardly from the front ends of the partial lock guide portions 26A. A partial lock projection 26C is formed in each partial lock guide portion 26A, and a full lock projection 26D is formed at the upper end of each full lock guide portion 26B. On the other hand, partial lock projections 26E are formed in lower areas of the inner side surfaces of the mount portion 24.

An operable hole 25D is formed in a position of the front wall of the mount portion 24 substantially below the housing main body 22, and a pair of wire escape grooves 26F are formed in the bottom wall thereof.

Openings 25E extending substantially along the outer edges of the CDP through holes 25B are holes made e.g. by a mold to substantially form the guide portions 26A, 26B, and vertically elongated openings 25F at the opposite sides of the operable hole 25D are holes made by the mold to form the lower partial lock projections 26E.

The female terminal fitting 30 is comprised of a box-shaped terminal main body 31 to be inserted into the cavity 23, and a wire connection portion 32 extending downward at an angle different from 0° or 180°, preferably substantially at right angles from the rear end of the terminal main body 31. A wire 33 is connected with the wire connection portion 32 by cramping. In the lower surface of the terminal main body 31 a metal lance or locking portion 34 is formed for engagement with the primary locking portion 23A of the cavity 23. A lower portion of the rear end surface of the terminal main body 31 acts as a receiving portion 35 that is engageable with the retainer 140 for effecting secondary locking.

The retainer 140 is in the form of a thick plate and is so dimensioned as to be vertically displaceable in the mount portion 24 of the female connector housing 21. In an upper portion of the retainer 140 a pair of through holes 141 are formed through which the female terminals 30 are to be inserted. Secondary locking portions 142 engageable with the receiving portions 35 of the female terminal fittings 30 project at the bottom edges of the through holes 141. An operable projection 143 is formed on the front surface of the retainer 140 in a position below the through holes 141. A partition wall 145 is formed on the rear surface of the retainer 140 which extends substantially vertically from a partitioning portion 144 between the through holes 141 to the bottom end. The female terminal fittings 30 are to be arranged at substantially opposite sides of this partition wall 145. At the upper ends of the opposite side edges of the retainer 140 are formed full lock grooves 146, below which substantially rectangular guide projections 147 are formed.

Such a retainer 140 is integrally or unitarily formed with elastic lock portions (lock means) 148 for locking the connector housings 11, 21 substantially in their properly connected state. The elastic lock portions 148 project substantially forward from the upper ends of the opposite sides of the retainer 140, the projecting ends hanging free are elastically deformable inward and preferably have a substantially rectangular shape when viewed sideways. At the projecting end of each elastic lock piece 148 is formed a lock claw 148A projecting outward. When viewed from front, the lock claws of the elastic lock portions 148 are in the form of arcs having the same center.

The engaging member 150 includes a main body 151 which preferably is substantially plate-shaped and has an outer shape matching an opening of the mount portion 24. A pair of short releasing portions 152 which preferably are defined in a plate or plate-like portion extend substantially horizontally from an upper end position of the front surface of the main body 151. A pair of connection detecting portions 153 extend in a direction at an angle different from 0° or 180°, preferably substantially downwardly from the outer edges of the respective short releasing portions 152 and are continuous with the front surface of the main body 151. Guide grooves 154 are formed in upper end positions of the opposite sides of the main body 151.

Before the connector housings 11, 21 are connected, the male tabs 13 are shorted by the shorting fitting 14 in the male connector 10. The female connector 20 is assembled in the following manner and fitted into the male connector 10.

Figure 26:
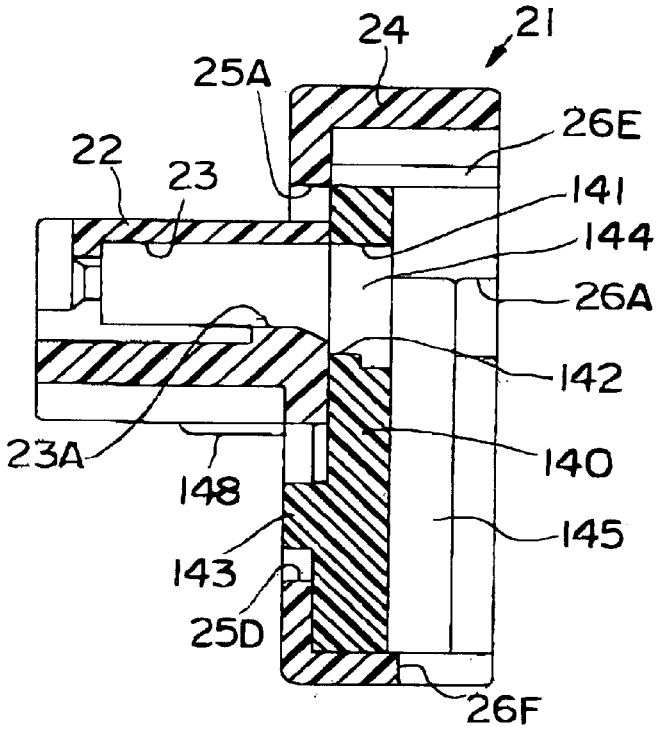
FIG. 26 is a vertical section of the female connector housing of the fifth embodiment.

Specifically, as shown in FIG. 26, the retainer 140 is pushed into the mount portion 24 of the female connector housing 21 preferably from substantially behind to be accommodated therein. At this time, the guide projections 147 are moved substantially parallel and forwardly along the partial lock guide portions 26A. When the retainer 140 is brought substantially into contact with the back end surface of the mount portion 24, the guide projections 147 move substantially beyond the partial lock projections 26C and the lower portion of the retainer 140 moves substantially beyond the partial lock projections 26E. As a result, the retainer 140 is held in its partial lock position by the partial lock projections 26C, 26E.

In this state, the elastic lock portions 148 project forward through the ELP through holes 25C, defining deformation spaces in conjunction with the side surfaces of the housing main body 22. The level of the elastic lock portions 148 is displaced preferably downward from the level where they are engageable with the lock grooves 16 of the male connector housing 11 when the connector housings 11, 21 are connected. If an attempt is made to connect the connectors 10, 20 in this state, the leading ends of the elastic lock portions 148 are struck against the front end of the male connector housing 11, making the connection impossible.

After the retainer 140 is partly locked, the terminal main bodies 31 of the female terminal fittings 30 are inserted into the cavities 23 through the through holes 141 preferably from behind. When the female terminal fittings 30 are properly inserted, the metal locking portions 34 engage the primary locking portions 23A, with the result that the primary locking of the female terminal fittings 30 is effected so as not to come out of the cavities 23.

Figure 27:
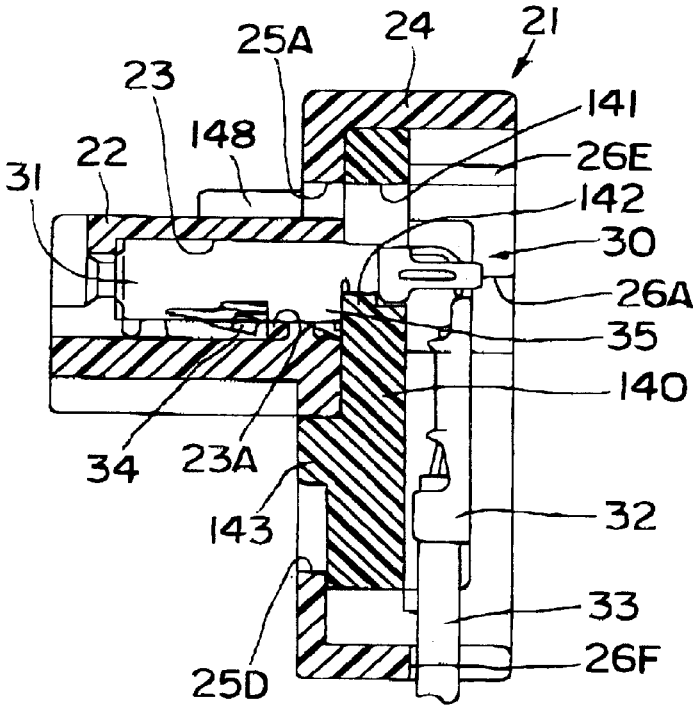
FIG. 27 is a vertical section of the fifth embodiment when the retainer and female terminal fittings are mounted in the female connector housing.
Figure 28:
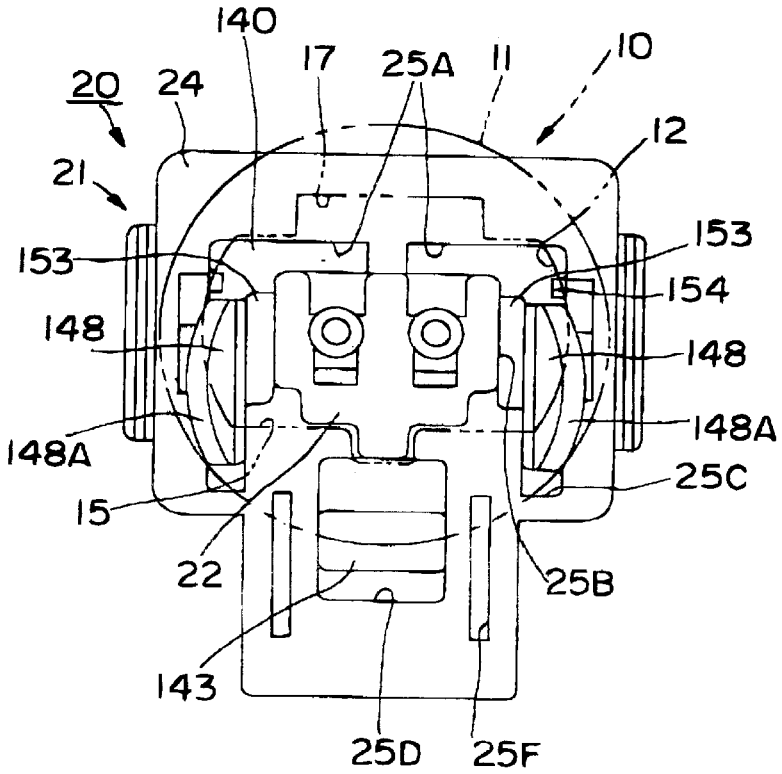
FIG. 28 is a front view of the fifth embodiment when the retainer is partly locked.
Figure 29:
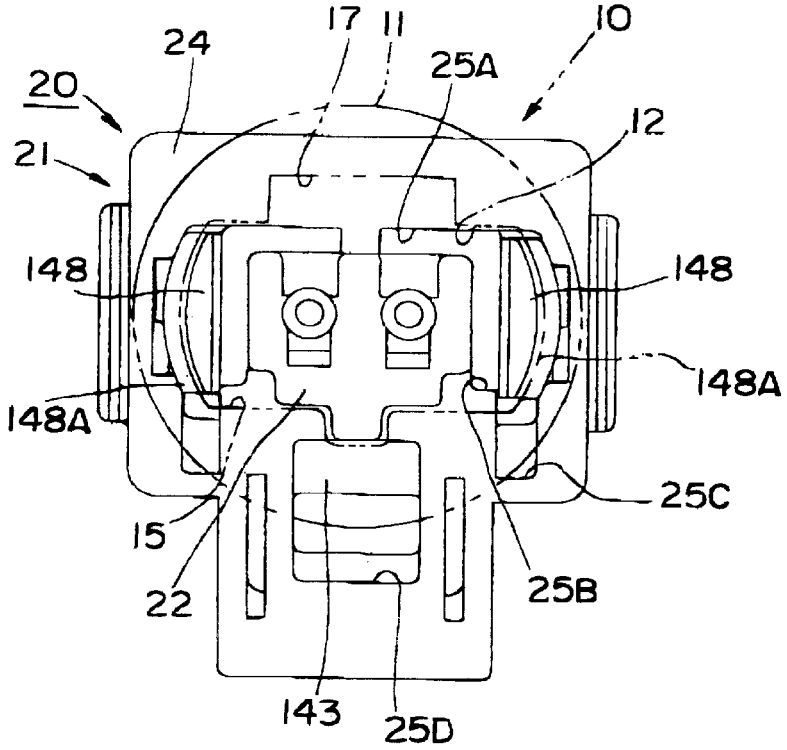
FIG. 29 is a front view of the fifth embodiment when the retainer is fully locked.
Figure 30:
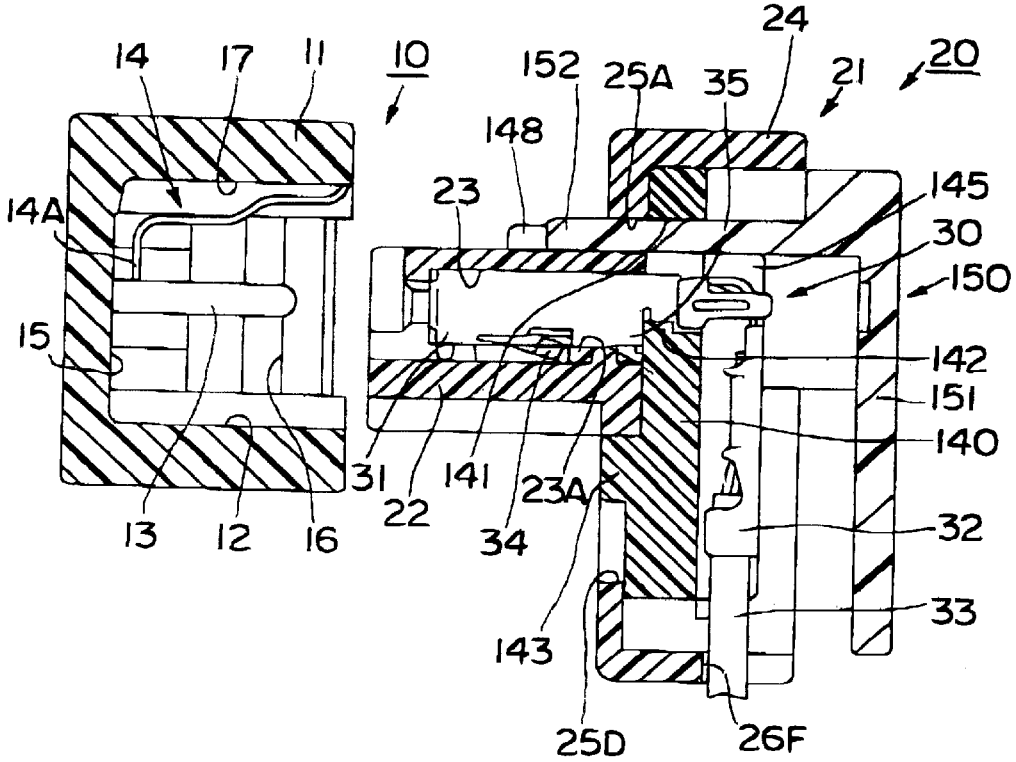
FIG. 30 is a vertical section of the fifth embodiment immediately before the connector housings are connected.
Figure 31:
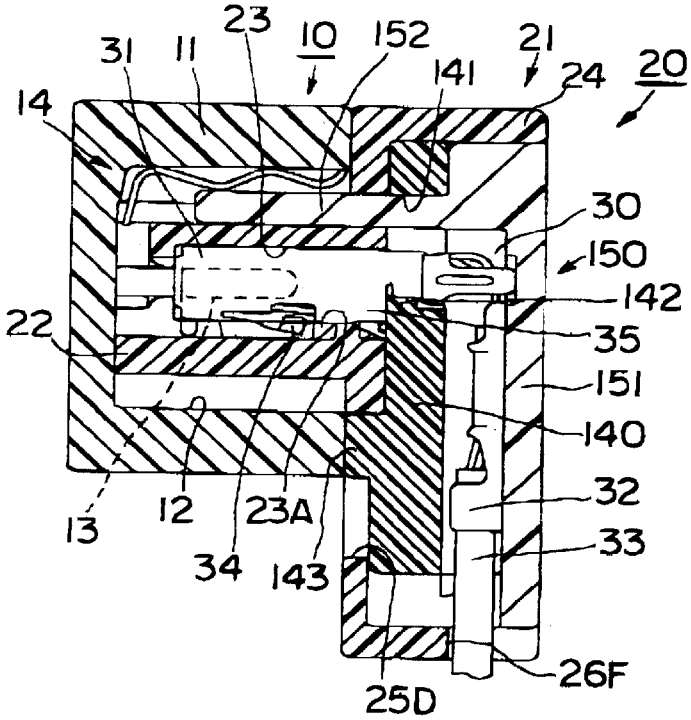
FIG. 31 is a vertical section of the fifth embodiment when the connection of the connector housings is completed.
Figure 32:
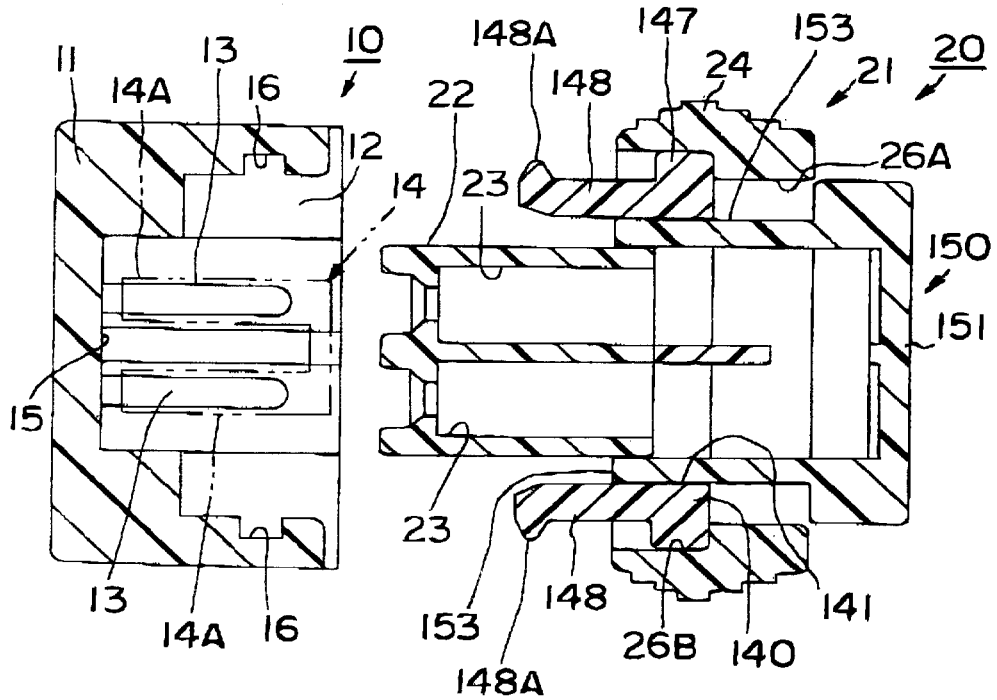
FIG. 32 is a horizontal section of the fifth embodiment immediately before the connector housings are connected.
Figure 33:
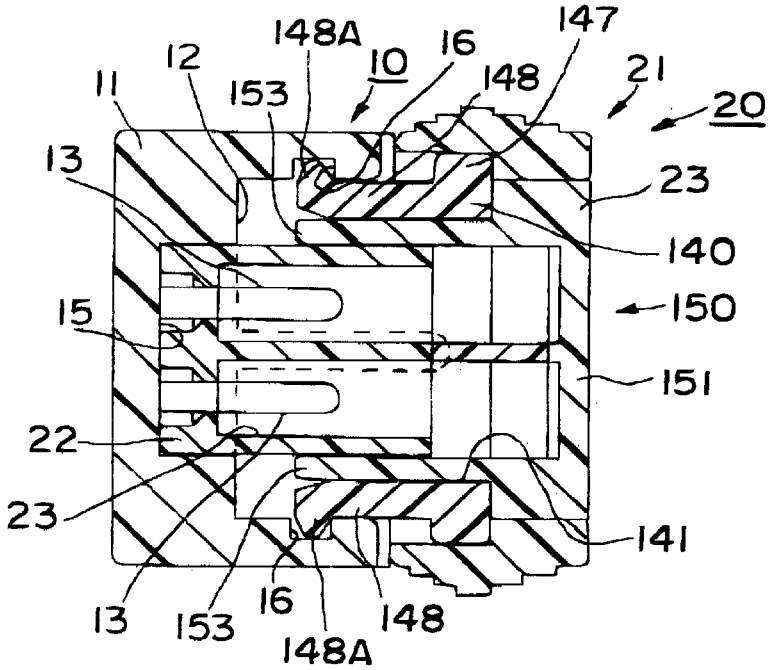
FIG. 33 is a horizontal section of the fifth embodiment when the connection of the connector housings is completed.
Figure 34:
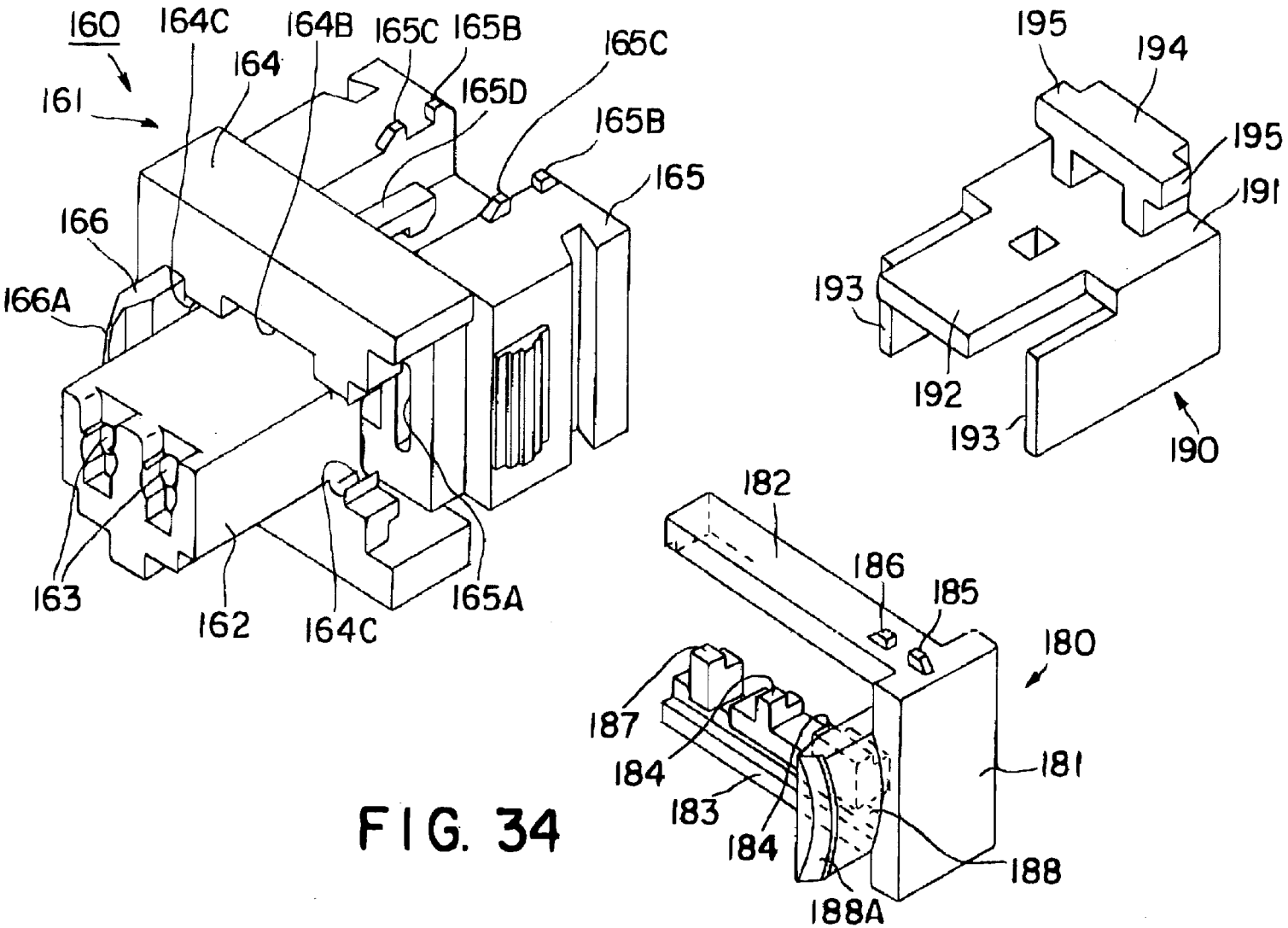
FIG. 34 is an exploded perspective view of a sixth embodiment.

When the female terminal fittings 30 are properly inserted, the retainer 140 is displaced upwardly as shown in FIG. 27 by operating the operable projection 143 in the operable hole 25D e.g. by finger. Then, the full lock grooves 146 are engaged with the full lock projections 26D and the retainer 140 is held in its full lock position. When the retainer 140 is displaced to its full lock position, the secondary locking portions 142 substantially engage the receiving portions 35 of the female terminal fittings 30. The female terminal fittings 30 are locked doubly by this secondary locking as well as the primary locking.

On the other hand, when the female terminal fittings 30 are inserted insufficiently, the retainer 140 cannot be displaced to its full lock position even if an attempt is made to push up the retainer 140 in its partial lock position because the secondary locking portions 142 are obstructed by the female terminal fitting 30, and preferably by the lower surfaces of the terminal main bodies 31. In this way, the insufficient insertion of the female terminal fittings 30 is detected. In such a case, the female terminal fittings 30 are reinserted to their proper insertion positions and then the retainer 140 is displaced to its full lock position.

When the retainer 140 is displaced to its full lock position, the elastic lock portions 148 that are integral or unitary therewith are displaced laterally, and preferably upward. As a result, the elastic lock portions 148 become engageable with the lock grooves 16 without being struck against the male connector housing 11 (see FIG. 29). When the retainer 140 is in its partial lock position, the SRP through holes 25A are substantially closed by the upper end of the retainer 140. By the displacement of the retainer 140 to its full lock position, these through holes 25A are substantially opened so as to allow the passage of the short releasing portions 152.

Subsequently, the engaging member 150 is assembled slightly with the female connector housing 21 preferably from behind (see FIGS. 30 and 32), causing the short releasing portions 152 and the connection detecting portions 153 to pass through the through holes 141 of the retainer 140, the SRP through holes 25A and the CDP through holes 25B.

At this time, if the SRP through holes 25A cannot allow the passage of the short releasing portions 152 because they are closed or covered substantially by the retainer 140, it can be detected that the retainer 140 has not been displaced to its full lock position. In other words, the female terminal fittings are or may be insufficiently inserted. In such a case, the female terminal fittings 30 are reinserted to their proper positions and the retainer 140 is substantially displaced to its full lock position.

Subsequently, the female connector housing 21 is connected with the male connector housing 11 with the engaging member 150 slightly assembled or preassembled. In this state, the elastic lock portions 148 are fitted into the male connector housing 11 while being elastically deformed or deflected inwardly since the connection detecting portions 153 are located therebehind and thus allow a deformation. When the connector housings 11, 21 are connected properly, the elastic lock portions 148 are engaged with the lock grooves 16, thereby locking the connector housing 11, 21 in their properly connected state. In this state, the short releasing portions 152 are kept out of contact with the shorting fitting 14 since they project forwardly only a short distance and, accordingly, the male tabs 13 are held shorted. Alternatively, the short releasing portion 152 may be in contact with the short fitting 14 without deflecting it out of contact from the terminal fittings or male tabs 13.

Thereafter, the engaging member 150 is pushed deeply into the mount portion 24. The short releasing portions 152 accordingly move forward and slip between the shorting fitting 14 and the male tabs 13 to elastically deform the shorting fitting 14 away from the tabs 13, preferably substantially upward. As a result, the shorting fitting 14 is separated from the male tabs 13, thereby releasing the shorted state of the male tabs 13.

The connection detecting portions 153 also travel forward as the engaging member 150 is pushed in and are located along the inner side surfaces of the elastic lock portions 148. This substantially prevents the inward displacement or deflection of the elastic lock portions 148, i.e. the disengagement thereof from the lock grooves 16. As a result, the connector housings 11, 21 are doubly locked. If the connector housings 11, 21 are partly connected, the elastic lock portions 148 are elastically displaced inwardly by the interference of the inner surface of the male connector housing 11. Accordingly, the clearances between the elastic lock portions 148 and the housing main body 22 are so narrow or dimensioned such that the connection detecting portions 153 cannot enter (not shown) or interact. Therefore, the engaging member 150 cannot be pushed in. In other words, the connected state of the connector housings 11, 21 can be detected based on whether or not the engaging member 150 can be pushed in.

In this embodiment, the connectors are assembled by connecting the connector housings 11, 21 with the engaging member 150 detached from the female connector housing 21 and then mounting the engaging member 150 on the female connector housing 21. In this case, there is a possibility that the connector housings 11, 21 are connected, overlooking that the female terminal fittings 30 are insufficiently inserted and the retainer 140 is in its partial lock position. However, since the elastic lock portions 148 are displaced to positions below their proper positions with the retainer 140 in its partial lock position, they come substantially into contact with the front end of the male connector housing 11 while the connector housings 11, 12 are being connected, making the connection impossible. Thus, it can be detected that the retainer is in its partial lock position, i.e. the female terminal fittings 30 are insufficiently inserted.

When the connectors 10, 20 are to be disconnected, the engaging member 150 is first displaced to its partial mount position or detached from the female connector housing 21. This brings the male tabs 13 into their shorted state and permits the elastic deformation of the elastic lock portions 148. Thereafter, if a force is applied to separate the connector housings 11, 21 from each other, the elastic lock portions 148 are disengaged from the lock grooves 16 while undergoing elastic deformation, with the result that the connector housings 11, 21 are disengaged.

As described above, the elastic lock portions 148 are integrally or unitarily formed on the retainer 140 and, when the retainer 140 is in its partial lock position, they are displaced from their proper positions and cannot effect their locking function. Accordingly, even if the detection by the retainer 140 is overlooked, the insufficient insertion of the female terminal fittings 30 can be detected based on whether or not the locking function of the elastic lock portions 148 can be effected when the connector housings 11, 21 are connected at a later stage. Thus, the insufficient insertion of the female terminal fittings 30 can securely be detected.

The insufficient insertion can also be detected by the elastic lock portions 148 being struck against or interacting with the front end of the male connector housing 11 to prevent the connector housings 11, 21 from being connected. Accordingly, it takes less time and labor to check the locking function and operability is better as compared with a case where the locking function by the elastic lock portions is checked after the connector housings are properly connected.

A sixth embodiment of the invention is illustrated in FIGS. 34 to 41. Since a male connector 10 into which a female connector 160 of this embodiment is fitted has the same construction as that of the fifth embodiment, no description is given thereon.

The female connector 160 is comprised of a female connector housing (connector housing) 161 to be connected with the male connector housing 11, female terminal fittings 170 to be substantially mounted in the female connector housing 161, a retainer 180 to be substantially mounted on the female connector housing 161, and an engaging member 190 to be substantially mounted on the female connector housing 161.

The female connector housing 161 includes a housing main body 162 formed with a pair of cavities 163, a retainer mount portion 164 formed substantially in a middle portion of the housing main body 162 with respect to forward and backward directions, and an engaging member mount portion 165 which is so formed as to substantially enclose a rear half area of the housing main body 162. The female terminal fittings 170 are inserted into the cavities 163 through their rear end openings, and a primary locking portion 163A engageable with the female terminal fitting 170 is formed in each cavity 163.

The interior of the retainer mount portion 164 is a space which is open in one side surface and communicates with the cavities 163. The retainer 180 is to be accommodated in this space. Locking projections 164A are formed at upper and lower ends of the opening of the retainer mount portion 164 (see FIG. 38). On the front surface of the retainer mount portion 164 is formed a forward projecting elastic lock portion 166 for locking the connector housings 11, 161 into each other. The elastic lock portion 166 is elastically deformable substantially inward. A lock claw 166A projecting outward is formed at the projecting end of the elastic lock portion 166. This lock claw 166A has a comblike shape when viewed from front and is positioned such that an arc defined by the lock claw 166A preferably has the substantially same center as an arc defined by a lock claw 188A of an elastic lock portion 188 of the retainer 180 to be described later. The retainer mount portion 164 is formed with a short releasing portion (SRP) through hole 164B which substantially extends in forward and backward directions along the upper surface of the housing main body 162, connection detecting portion (CDP) through holes 164C which substantially extend along forward and backward directions along the opposite side surfaces of the housing main body 162.

The upper surface of the engaging member mount portion 165 is recessed in its middle part with respect to transverse direction. Connection detecting portion (CDP) through holes 165A are defined between the opposite side surfaces of the engaging member mount portion 165 and the outer side surfaces of the housing main body 162. A pair of front and rear locking projections 165B, 165C are formed at the opening edge of the upper surface, and an elastic locking portion 165D is formed in the opening of the upper surface, and projects substantially backward from the retainer mount portion 164, such that the projecting end hangs free.

Each female terminal fitting 170 includes a substantially box-shaped terminal main body 171 to be inserted into the corresponding cavity 163 and a wire connection portion 172 extending backward from the rear end of the terminal main body 171. A wire 173 is connected with the wire connection portion 172 e.g. by cramping. On the lower surface of the terminal main body 171 is formed a metal lance or locking portion 174 engageable with the primary locking portion 163A of the cavity 163. A lower portion of the rear end surface of the terminal main body 171 acts as a receiving portion 175 engageable with the retainer 180 for effecting secondary locking.

The retainer 180 includes a substantially rectangular main body 181 and at least one pair of -arms 182, 183 projecting sideways (or along a direction at an angle different from 0° or 180°, preferably substantially normal to the insertion direction of the terminal fittings 170 into the housing main body 162) from the upper and bottom ends of the main body 181, the projecting ends substantially hanging free. Secondary locking portions 184 engageable with the receiving portions 175 of the female terminal fittings 170 are formed on the inner or upper surface of the lower arm 183, whereas a pair of locking projections 185, 186 are formed on the outer or upper surface of the upper arm 182. The retainer 180 is selectively mountable by inserting the arms 182, 183 sideways into the retainer mount portion 164 in a partial lock position shown in FIGS. 38 and 40 and in a full lock position shown in FIGS. 39 and 41. In the partial lock position, a loose movement of the retainer 180 is restricted by the locking projections 185, 186 of the retainer 180 tightly holding the upper locking projection 164A of the retainer mount portion 164 therebetween. In the full lock position, one lock projection 185 of the retainer 180 substantially engages the inside of the upper lock projection 164A of the retainer mount portion 164, and a stopper 187 of the retainer 180 is substantially in contact with the back end surface of the retainer mount portion 164, thereby restricting a loose movement of the retainer 180.

Such a retainer 180 is integrally or unitarily formed with the elastic lock portion (lock means) 188 for locking the connector housings 11, 161 in their connected state. The elastic lock portion 188 projects substantially forward from the main body 181 and is elastically deformable or deflectable inward. At the projecting end of the elastic lock portion 188 is formed the lock claw 188A. This lock claw 188A has a substantially comblike or curved shape when viewed from front. With the retainer 180 fully locked, the lock claw 188A and the lock claw 164A of the elastic lock portion 166 of the female connector housing 161 are positioned on concentric circles.

The engaging member 190 includes a main body 191 in which side walls extend at an angle different from 0° or 180°, preferably substantially downward at right angles from the opposite sides of the upper wall, a short releasing portion 192 which is a plate projecting forward from the upper wall of the main body 191, and a pair of connection detecting portions 193 substantially likewise projecting forward from the opposite side walls of the main body 191. A substantially bridge-shaped or gate-shaped raised portion 194 is formed on the upper surface of the upper wall, and locking projections 195 are formed at the upper ends of the opposite side surfaces of the raised portion 194.

With the connector housings 11, 161 unconnected, the male tabs 13 are shorted by the shorting fitting 14 in the male connector 10 (not shown). On the other hand, the female connector 160 is assembled and connected with the male connector 10 in the following procedure.

Figure 35:
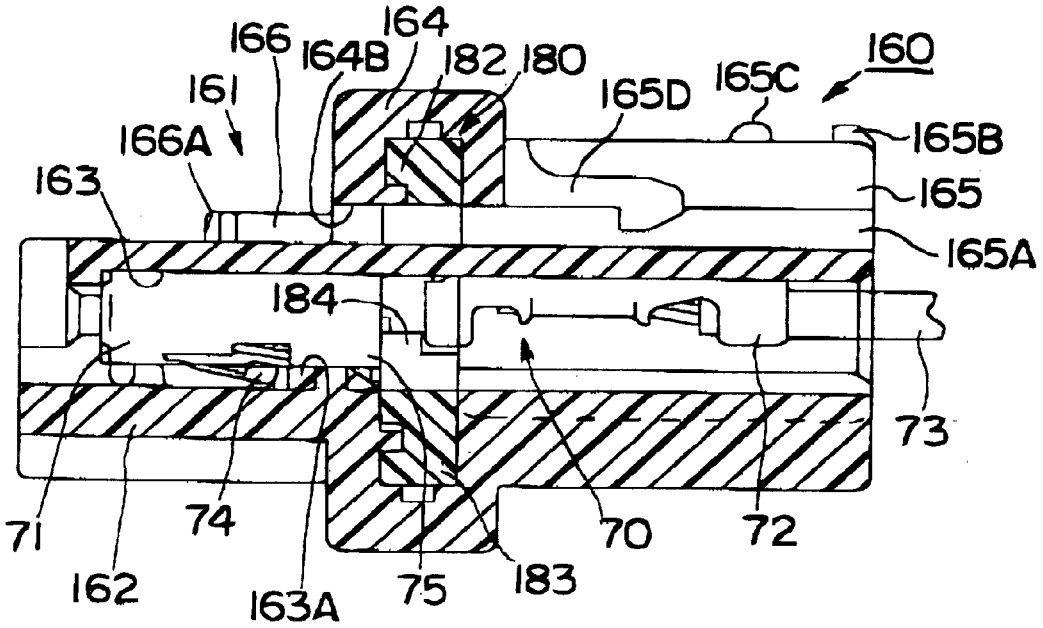
FIG. 35 is a vertical section of the sixth embodiment when the retainer is partly locked with the female connector housing and the female terminal fittings are inserted.
Figure 36:
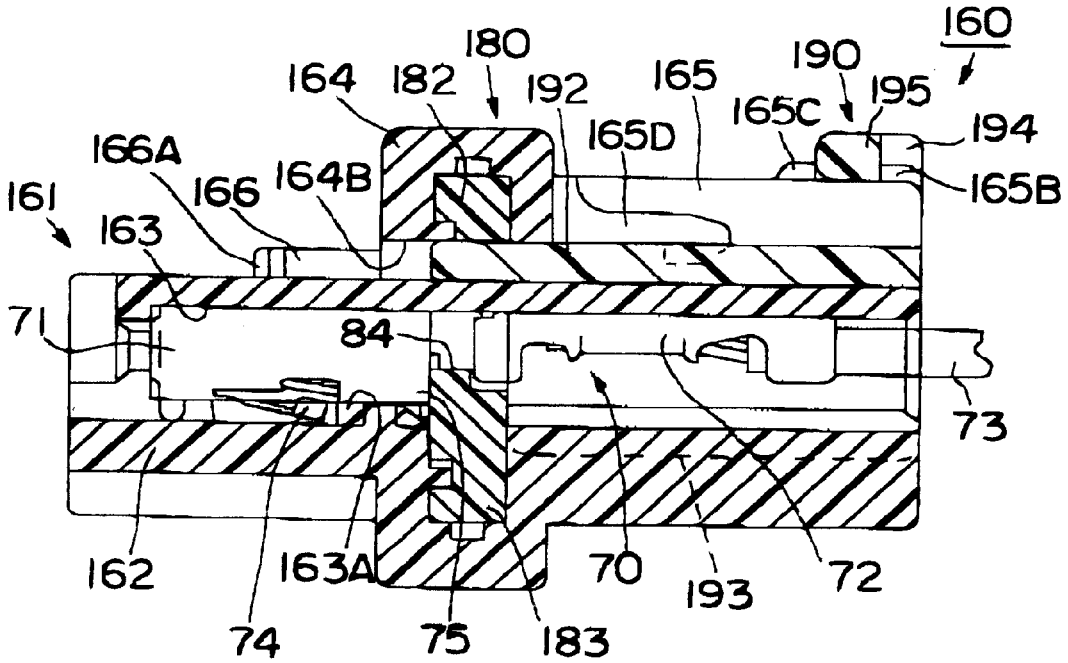
FIG. 36 is a vertical section of the sixth embodiment when the retainer is fully locked and an engaging member is partly locked.
Figure 37:
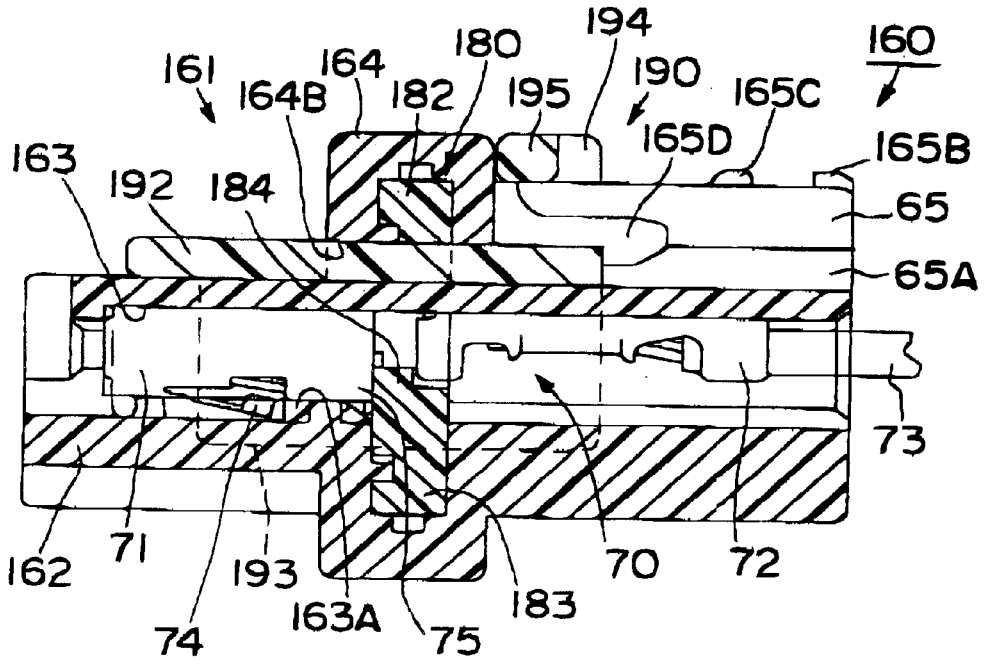
FIG. 37 is a vertical section of the sixth embodiment when the engaging member is fully locked.
Figure 38:
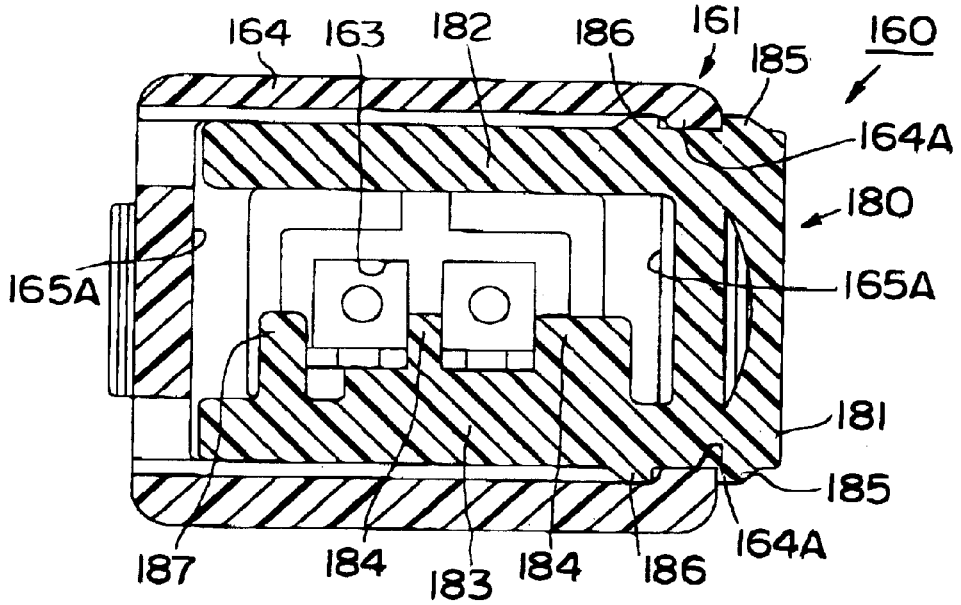
FIG. 38 is a horizontal section of the sixth embodiment when the retainer is partly locked.
Figure 39:
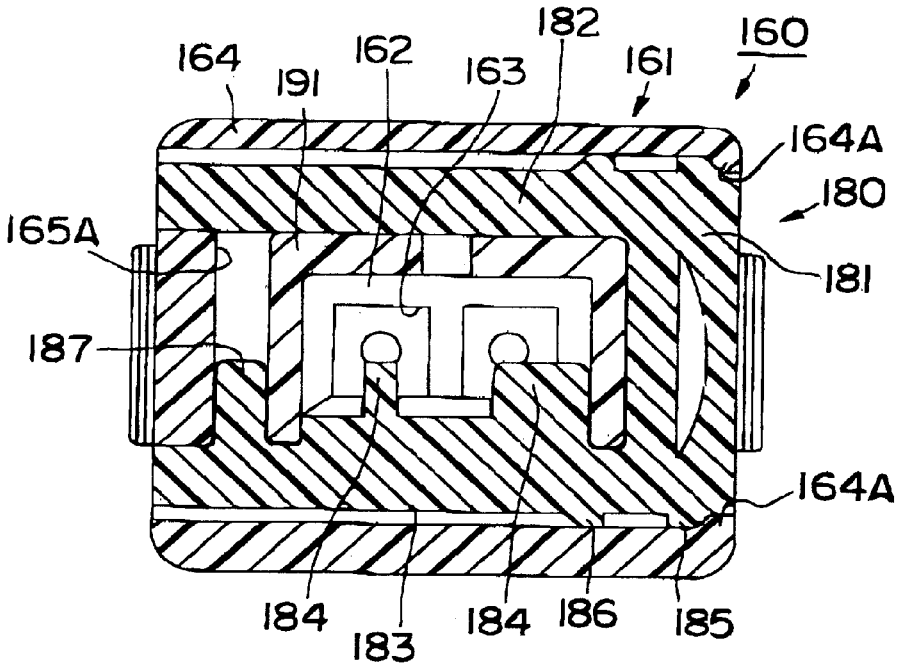
FIG. 39 is a horizontal section of the sixth embodiment when the retainer is fully locked.
Figure 40:
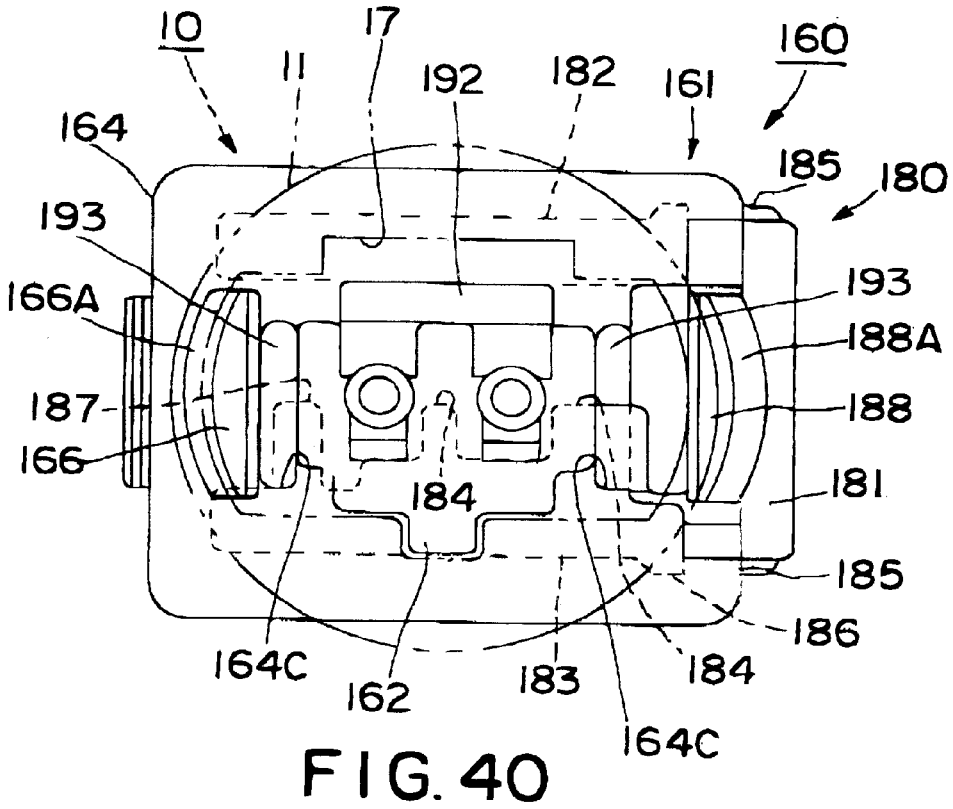
FIG. 40 is a front view of the sixth embodiment when the retainer is partly locked.
Figure 41:
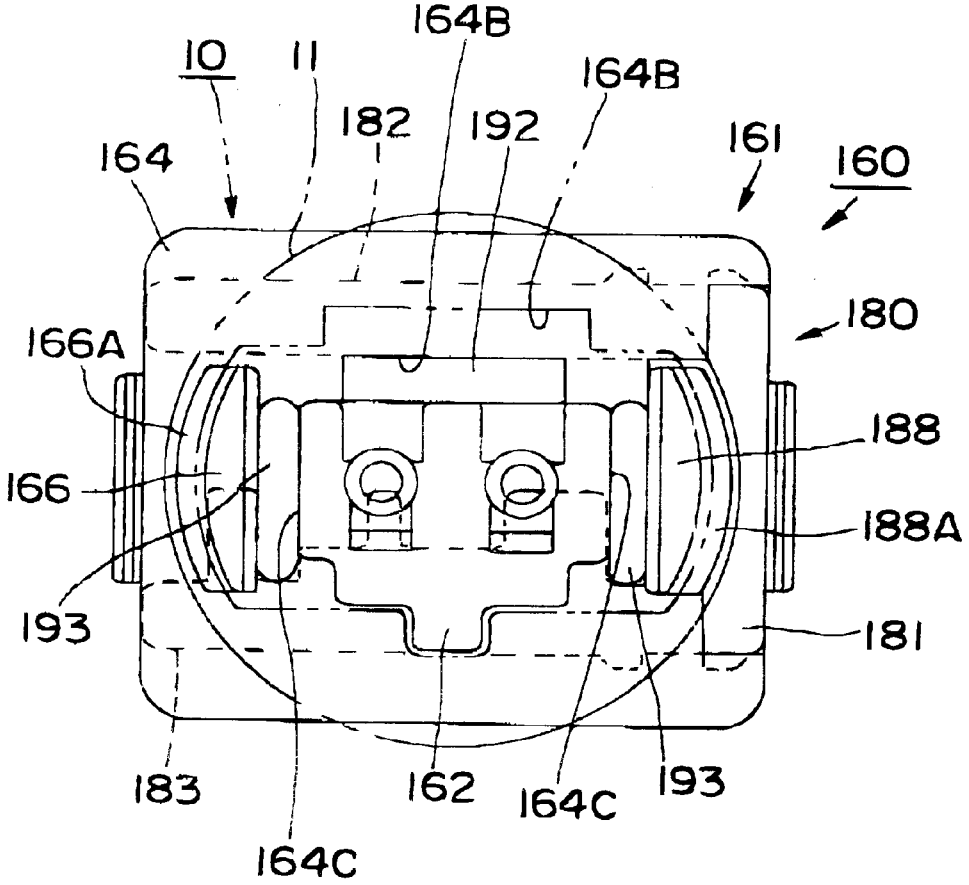
FIG. 41 is a front view of the sixth embodiment when the retainer is fully locked.
Figure 42:
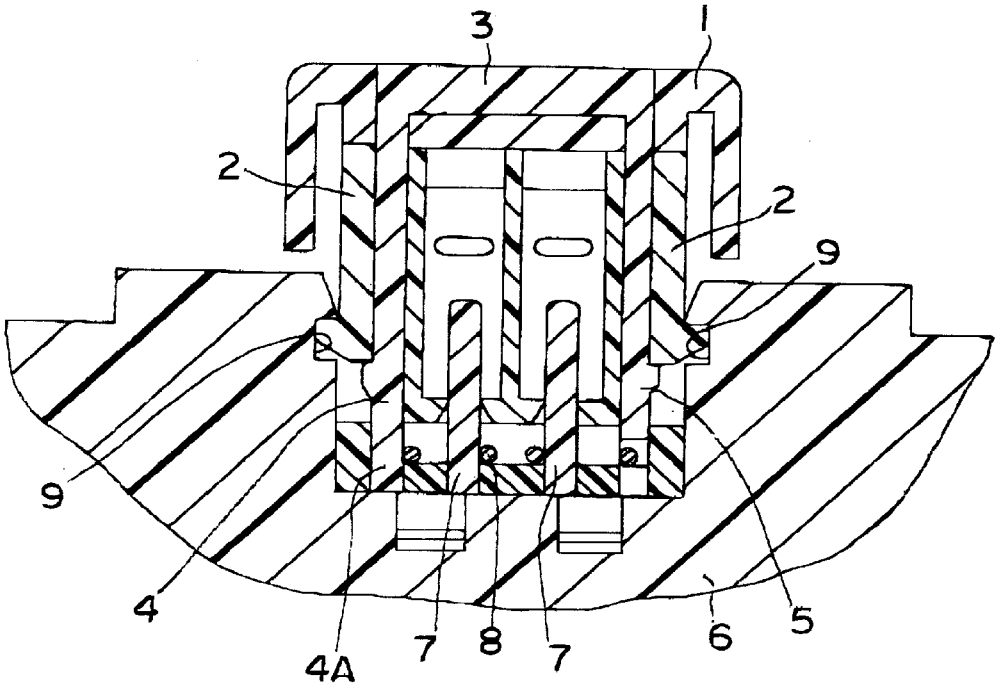
FIG. 42 PRIOR ART
FIG. 42 is a section of a prior art when both connectors are connected.
Figure 43:
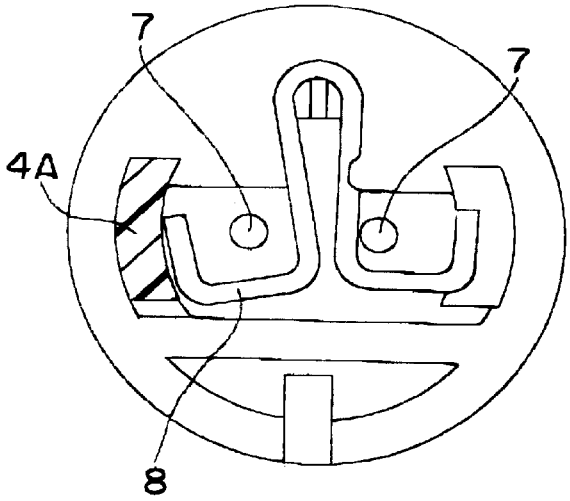
FIG. 43 PRIOR ART
FIG. 43 is an enlarged partial plan view partly in section of the prior art when the shorted state of male tabs is released.

Specifically, the retainer 180 is inserted into the retainer mount portion 164 sideways to be held in its partial lock position (see FIG. 35). In this state, since the secondary locking portions 184 are not in alignment with the cavities 163 as shown in FIG. 38, the female terminal fittings 170 can be inserted into the cavities 163. With the retainer 180 in its partial lock position, the elastic lock portion 188 of the retainer 180 is substantially displaced relatively outward from its position where it is engageable with the lock groove 16 of the male connector housing 11 when the connector housings 11, 161 are connected (see FIG. 40). If an attempt is made to connect the connectors 10, 160 in this state, the leading end of the elastic lock portion 188 comes into contact with the front end of the male connector housing 11, making the connection impossible.

Next, with the retainer 180 in its partial lock position, the engaging member is at least partially inserted into the engaging member mount portion 165 preferably from behind to be partly locked. At this time, the engaging member 190 is held in its partial lock position (see FIG. 36) by the locking projections 195 thereof being held between the lock projections 165B, 165C of the mount portion 165. In this state, since the connection detecting portions are located at a distance, preferably substantially behind the elastic lock portions 166, 188 (not shown), the elastic lock portions 166, 188 are elastically deformable inward.

After the retainer 180 and the engaging member 190 are partly locked, the female terminal fittings 170 are inserted or insertable into the cavities 163 preferably from behind. When the female terminal fittings 170 are properly inserted, the metal locking portions 174 engage the primary locking portions 163A, with the result that the primary locking of the female terminal fittings 170 is effected so as not to come out of the cavities 163.

The retainer 180 is pushed in after the insertion of the female terminal fittings 170. At this time, the retainer 180 is displaced to its full lock position if the female terminal fittings 170 are properly inserted, whereas the retainer 180 cannot be displaced to its full lock position because of the secondary locking portions 184 of the retainer 180 being interfered by or interacting the side surfaces of the terminal main body 171 if they are insufficiently inserted. In other words, the insufficient insertion of the female terminal fittings 170 can be detected based on whether or not the retainer can be displaced to its full lock position. In the case of detecting the insufficient insertion, the retainer 180 is displaced to its full lock position after the female terminal fittings 170 are reinserted to their proper positions.

Upon the displacement of the retainer 180 to its full lock position, the secondary locking portions 184 engage the receiving portions 175 of the female terminal fittings 170. The female terminal fittings 170 are doubly locked by the secondary locking and the primary locking (see FIG. 36). As the retainer 180 is displaced to its full lock position, the elastic lock portion 188 integral or unitary with the retainer 180 is displaced inward, i.e. in a direction substantially toward the elastic lock portion 166 of the female connector housing 161 and becomes engageable with the lock groove 16 without being interfered by the male connector housing 11 (see FIG. 41).

Thereafter, the female connector housing 161 is connected with the male connector housing 11. At this time, the connection detecting portion 193 is located at a distance or behind the elastic lock portions 166, 188, which are accordingly fitted into the male connector housing 11 while being elastically deformed inward. When the connector housings 11, 161 are properly connected, the elastic lock portions 166, 188 are engaged with the lock grooves 16 (not shown), with the result that the connector housings 11, 161 are locked in their connected state. Since the short releasing portion 192 projects forward a short distance in this state (see FIG. 36), the short releasing portion 192 is preferably kept out of contact with the shorting fitting 14 and the male tabs 13 are kept shorted (not shown).

Thereafter, when the engaging member 190 is inserted to its full lock position, the short releasing portion 192 moves forward (see FIG. 37), thereby elastically displacing the shorting fitting 14 upward or away from the male tabs 13 to release the shorted state of the male tabs 13.

On the other hand, the connection detecting portion 193 moves forward as the engaging member 190 is moved to be located along at least part of the inner surfaces of the elastic lock portions 166, 188 (not shown). This prevents the elastic lock portions 166, 188 from being substantially displaced inward or disengaged from the lock grooves 16, with the result that the connector housings 11, 161 are doubly locked.

If the connector housings 11, 161 are partly connected, the elastic lock portions 166, 188 are elastically displaced inward by being interfered by the inner surfaces of the male connector housing 11. Accordingly, the engaging member 190 cannot be pushed in, since the clearances between the elastic lock portions 166, 188 and the housing main body 162 are so narrow or dimensioned such that the connection detecting portions 193 cannot enter or are interfered (not shown). In other words, the connected state of the connector housings 11, 161 can be detected based on whether or not the engaging member 190 can be pushed in.

In the above operation, if the connector housings 11, 161 are connected with the female terminal fittings 170 insufficiently inserted and the retainer 180 in its partial lock position, i.e. if the insufficient insertion detection by the retainer 180 is overlooked, the insufficient insertion can be detected during the connector connecting operation. Specifically, with the retainer in its partial lock position, the elastic lock portion 188 of the retainer 180 is displaced more outward than its proper position. Thus, the connector housings 11, 161 cannot be connected because the elastic lock portion 188 comes into contact with the front end of the male connector housing 11. This makes it detectable that the retainer 180 is in its partial lock position, i.e. the female terminal fittings 170 are insufficiently inserted.

When the connectors are to be disconnected, the engaging member 190 is first displaced to its partial mount position or detached from the female connector housing 161. This brings the male tabs 13 into their shorted state and permits the elastic deformation of the elastic lock portions 166, 188. Thereafter, if a force is applied to separate the connector housings 11, 161 from each other, the elastic lock portions 166, 184 are disengaged from the lock grooves 16 while undergoing elastic deformation, with the result that the connector housings 11, 21 are disengaged.

As described above, in the sixth embodiment, one elastic lock portion 188 is integrally or unitarily formed with the retainer 180 and substantially does not effect its locking function by being displaced from its proper position when the retainer 180 is in its partial lock position. Accordingly, even if the detection of the insufficient insertion of the female terminal fittings 170 by the retainer 180 is overlooked, the insufficient insertion is detected based on whether or not the locking function by the elastic lock portion 188 is effectible when the connector housings 11, 161 are connected. Therefore, the insufficient insertion of the female terminal fittings 170 can securely be detected.

In the sixth embodiment, the insufficient insertion is detected by the elastic lock portion 188 being struck against or interacting with the front end of the male connector housing 11 to prevent the connection of the connector housings 11, 161. Accordingly, it takes less time and labor to check the locking function and operability is better as compared with a case where the locking function by the elastic lock portions is checked after the connector housings are connected in their proper positions.

The present invention is not limited to the described and illustrated embodiments. For example, the following embodiments are also embraced by the technical scope of the present invention as defined in the claims. Besides the following embodiments, a variety of other changes can be made without departing from the scope and spirit of the invention as defined in the claims.

Although the elastic lock portions are provided on the female connector housing in the foregoing embodiments, they may be provided on the male connector housing according to the invention.

Although the short releasing member and the connection detecting member are mounted on the female connector housing in the foregoing embodiments, they may be mounted on the male connector housing according to the invention.

Although either or both of the pair of elastic lock portions are formed on the retainer in the first and second embodiments, both elastic lock positions may be formed on the connector housing according to the invention. In this case, the retainer may not be necessary if the terminal fittings and the wires are connected by cramping instead of by deforming the terminal fittings.

Although the short releasing portion does not touch the shorting fitting when the short releasing member is pushed to its full lock position with the connectors partly connected in the third embodiment, it may touch the shorting fitting to release the shorted state of the male tabs. In this case, since the partial connection is detected by the connection detecting member and the connectors are reconnected, there is no likelihood that the shorted state of the male tabs remains.

In the third embodiment, the biasing means is the compression coil springs and the connector housing is of the cramping type. However, according to the invention, the connector housing may integrally be formed with the biasing means. Further, the invention is also applicable to connector housings of the type in which wires are connected with terminal fittings by deforming the terminal fittings.

The insufficient insertion of the terminal fittings is detected by the elastic lock portions being struck against the front end surface of the mating connector housing in the foregoing embodiments. However, according to the invention, the elastic lock portions may be so constructed as not to be engageable with the mating lock grooves although they are insertable into the mating connector housing. Even in such a case, the connector housings are disconnected upon being pulled apart without the locking function being effected. Thus, the insufficient insertion of the female terminals can be detected based on whether or not the connector housings can be disconnected as above.

Although the both tabs are shorted in the mating connector housing in the foregoing embodiments, the invention is also applicable to connectors in which the shorted state of tabs of a mating connector needs not be released.

Although the connector is provided with the connection detecting portions engageable along the inner surfaces of the elastic lock portions in the foregoing embodiments, the invention is also applicable to connectors in which such connection detecting portions are not provided.

Although the retainer is assembled with the female connector housing in the foregoing embodiments, the invention is also applicable to connectors in which a retainer is assembled with a male connector housing.

What is claimed is:

1. A connector, comprising:

a first connector housing, first terminal fittings mounted in the first connector housing, a retainer movable on the first connector housing from a partial lock position where the retainer permits movement of the first terminal fittings in the first connector housing, to a full lock position where the retainer locks the first terminal fittings relative to the first connector housing, the retainer having at least one elastic lock portion which is displaceable between a lock position and an unlock position, a second connector housing having second terminal fittings therein and a short fitting in shorting engagement with the second terminal fittings, the connector housings being connectable in a partly connected condition with the elastic lock portion of the retainer being biased to the unlock position thereof, the connector housings being movable to a fully connected condition and locked in the fully connected condition by displacement of the elastic lock portion to the lock position, an engaging member movable between a partly mounted position and a fully mounted position on the first connector housing, the engaging member having a connection detecting member configured to permit movement of the engaging member on the first connector housing to the fully mounted position when the elastic lock portion is in the lock position, the connection detecting member further being configured to contact the elastic lock portion when the elastic lock portion is in the unlock position for preventing the engaging member from moving to the fully mounted position, and the engaging member further comprising a short releasing member configured for separating the short fitting from the second terminal fittings in the second connector housing when the engaging member is moved on the first connector housing to the fully mounted position.

2. The connector of claim 1, wherein the engaging member is displaceable along a direction substantially parallel to a mating direction of the first connector housing and the second connector housing.

3. The connector of claim 2, wherein the retainer is movable on the first connector housing in a direction transverse to the mating direction.

4. The connector of claim 3, wherein the elastic lock portion of the retainer is configured to prevent the first and second connector housings from being moved to the fully locked condition when the retainer is in the partial lock position on the first connector housing.

* * * * *